US010525361B2

(12) United States Patent
Cummins et al.

(10) Patent No.: US 10,525,361 B2
(45) Date of Patent: Jan. 7, 2020

(54) AMUSEMENT RIDE

(71) Applicant: Skysurfer International Limited, Wellington (NZ)

(72) Inventors: Robert Cummins, Wellington (NZ); Harry Robert John Cummins, Lower Hutt (NZ)

(73) Assignee: Skysurfer International Limited, Wellington (NZ)

( * ) Notice: Subject to any disclaimer, the term of this patent is extended or adjusted under 35 U.S.C. 154(b) by 0 days.

(21) Appl. No.: 16/068,394

(22) PCT Filed: Feb. 1, 2016

(86) PCT No.: PCT/NZ2016/050007

§ 371 (c)(1),
(2) Date: Jul. 6, 2018

(87) PCT Pub. No.: WO2017/135830

PCT Pub. Date: Aug. 10, 2017

(65) Prior Publication Data

US 2019/0022537 A1 Jan. 24, 2019

(51) Int. Cl.

| | |
|---|---|
| ***A63G 21/12*** | (2006.01) |
| ***A63G 7/00*** | (2006.01) |
| ***A63G 21/04*** | (2006.01) |

(52) U.S. Cl.

CPC ..... *A63G 21/12* (2013.01); *A63G 7/00* (2013.01); *A63G 21/04* (2013.01)

(58) Field of Classification Search

CPC ..... A63G 21/04; A63G 21/02; A63G 21/08; A63G 21/10; A63G 21/12; A63G 21/14; A63G 21/16; A63G 23/00; A63G 7/00

(Continued)

(56) References Cited

U.S. PATENT DOCUMENTS

| | | | |
|---|---|---|---|
| 3,167,024 | A | 1/1965 | Bacon et al. |
| 4,221,170 | A | 9/1980 | Koudelka |

(Continued)

FOREIGN PATENT DOCUMENTS

| | | | |
|---|---|---|---|
| EP | 2357028 | B1 | 9/2012 |
| FR | 2430781 | A1 | 2/1980 |

(Continued)

OTHER PUBLICATIONS

Wikipedia Contributors, "Brake Run", *Wikipedia, The Free Encyclopedia*, Dec. 12, 2004, 6 pages, retrieved from <https://en.wikipedia.org/wiki/Brake_run> on Jan. 19, 2016.

(Continued)

*Primary Examiner* — Mark T Le

(74) *Attorney, Agent, or Firm* — Alston & Bird LLP

(57) ABSTRACT

An amusement ride having a track (15) with a curved portion, a carriage (1) for holding an occupant (7) that is movable along the track, and a braking system. At least part of the carriage (1) will move in response to at least one inertial force acting upon the carriage as the carriage traverses the curved portion of the track, in the absence of a counteraction by an occupant of the carriage. The braking system operates in response to the movement of the at least part of the carriage (1) to inducing a braking force. Upon an action by an occupant of the carriage (1) to counteract the induction of the braking force, the braking force acting on the carriage is reduced or substantially avoided.

19 Claims, 20 Drawing Sheets

(58) Field of Classification Search
USPC ..... 104/247, 242, 63; 105/141, 142
See application file for complete search history.

(56) References Cited

U.S. PATENT DOCUMENTS

| | | | | |
|---|---|---|---|---|
| 4,335,658 | A * | 6/1982 | VanderKelen | A63G 21/06 104/124 |
| 6,155,176 | A | 12/2000 | Checketts | |
| 6,857,373 | B2 | 2/2005 | Checketts et al. | |
| 6,918,469 | B1 | 7/2005 | Pribonic et al. | |
| 7,980,181 | B2 | 7/2011 | Heaslip et al. | |
| 8,360,893 | B2 * | 1/2013 | Howard | A63G 21/08 104/53 |
| 8,636,600 | B2 * | 1/2014 | Howard | A63G 21/08 104/77 |
| 2004/0060470 | A1 | 4/2004 | Checketts et al. | |
| 2015/0135984 | A1 * | 5/2015 | Gastle | B61B 13/00 104/242 |

FOREIGN PATENT DOCUMENTS

| | | | |
|---|---|---|---|
| JP | 2000024327 | A | 1/2000 |
| WO | WO 2004/035164 | A1 | 4/2004 |
| WO | WO 2007/004904 | A1 | 1/2007 |
| WO | 2007055572 | A1 | 5/2007 |

OTHER PUBLICATIONS

International Searching Authority, International Search Report and Written Opinion for International Application No. PCT/NZ2016/050007, dated Apr. 29, 2016, 7 pages, Australian Patent Office, Australia.

Smoky Mountain Alpine Coaster, Pigeon Forge, Tennessee, U.S.A., Opened Aug. 3, 2013, retrieved from <https://www.smokymountainalpinecoaster.com> on Jun. 28, 2018, 8 pages.

Williams, Michael, "Mountain Coasters in National Park Offer the Newest Fun in Tennessee", Newsnet5, May 23, 2015, 4 pages, Cleveland, retrieved from <https://www.news5cleveland.com/lifestyle/family/mountain-coasters-in-national-park-offer-the-newest-fun-in-tennessee> on Jun. 28, 2018.

Extended European Search Report, dated Feb. 18, 2019, for European Patent Application No. 16889557.1, 8 pages, European Patent Office, Europe.

* cited by examiner

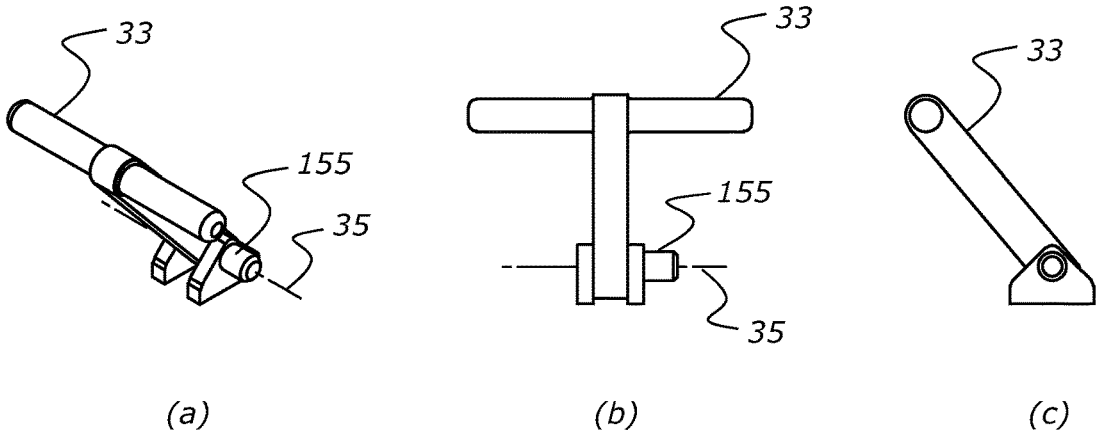
FIGURE 7(iii)

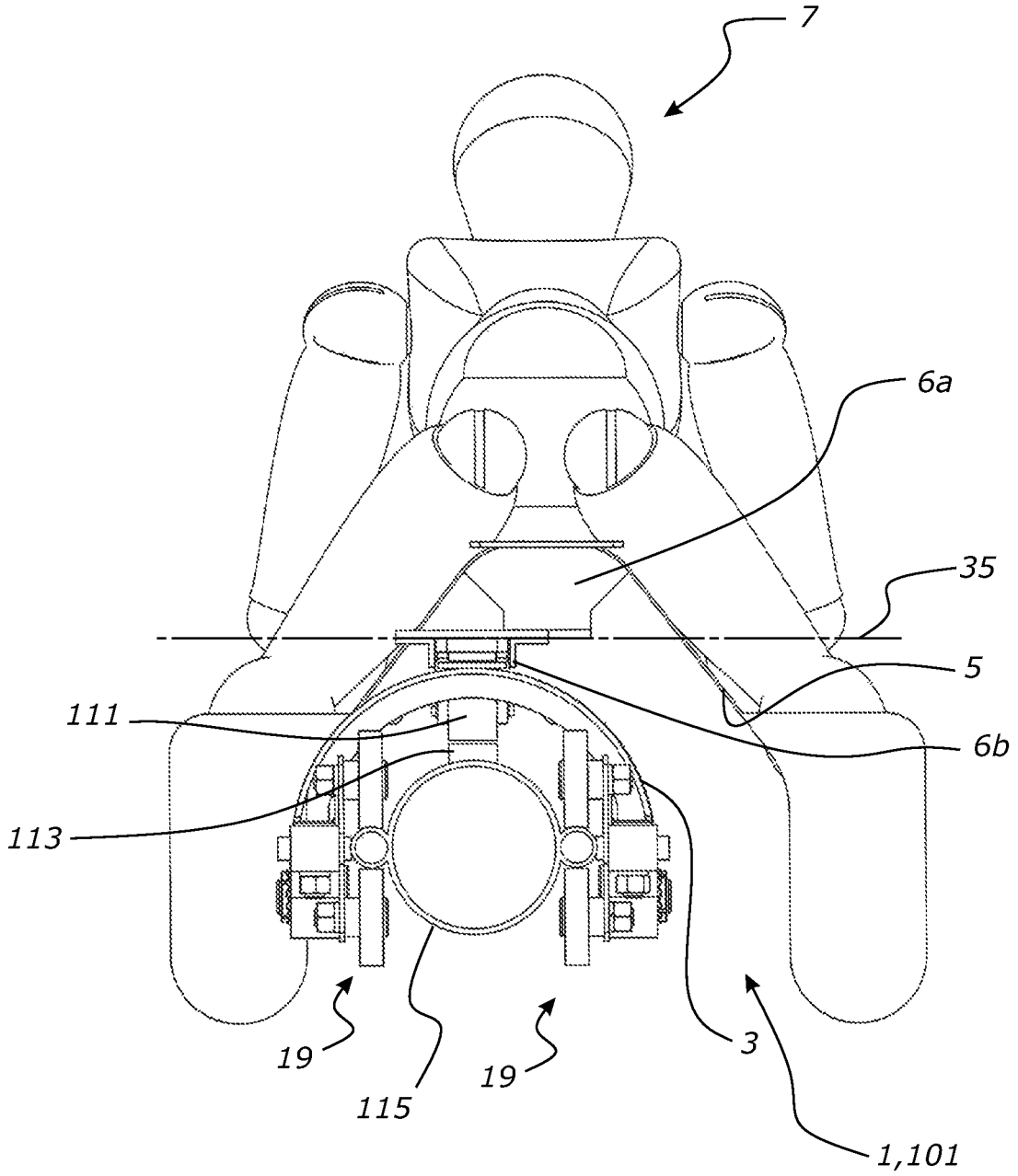
*FIGURE 8(iii)*

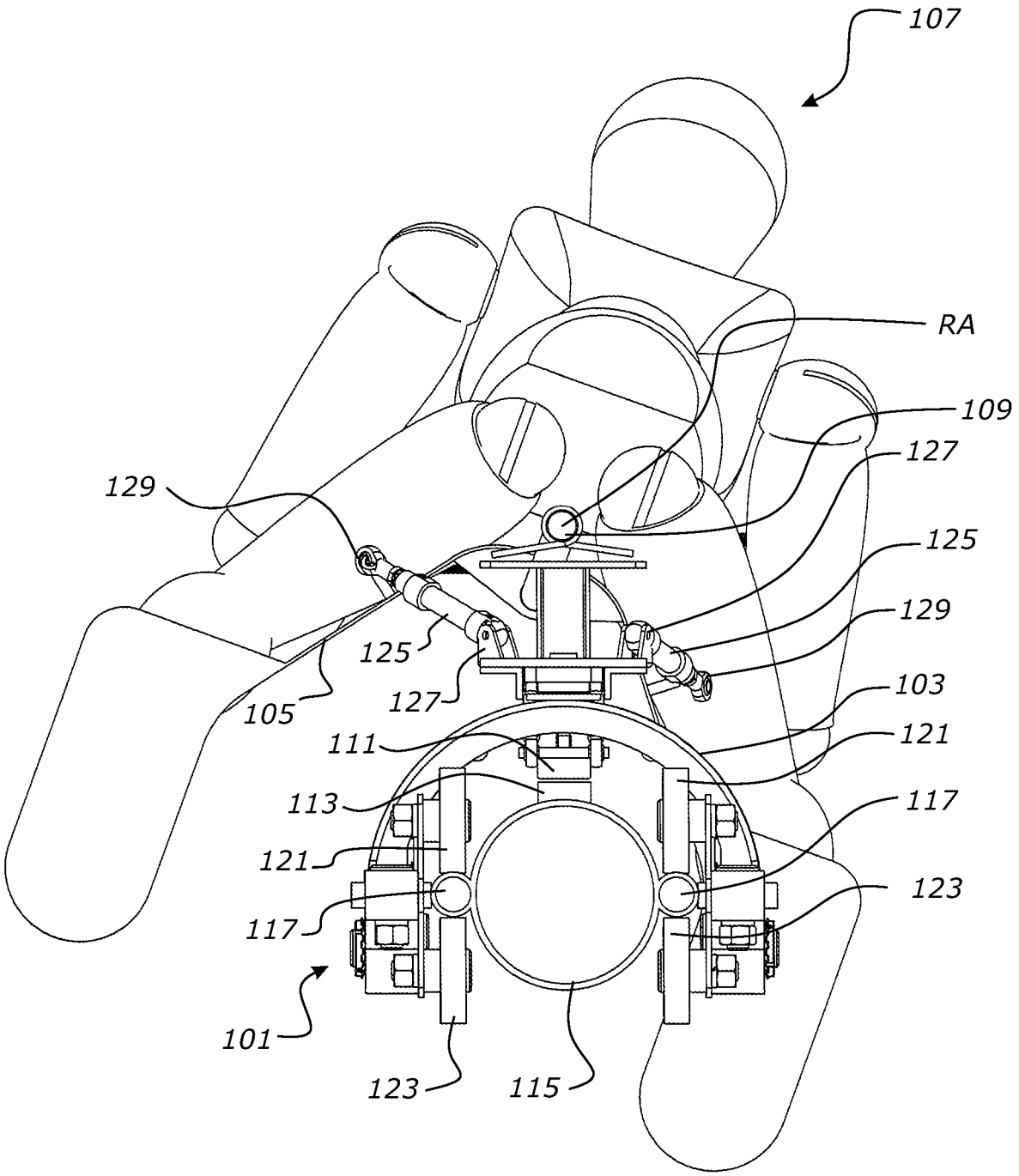
*FIGURE 14(iii)*

AMUSEMENT RIDE

CROSS REFERENCE TO RELATED APPLICATIONS

This application is a National Stage Application, filed under 35 U.S.C. § 371, of International Application No. PCT/NZ2016/050007, filed Feb. 1, 2016; the contents of which as are hereby incorporated by reference in their entirety.

BACKGROUND

Related Field

This invention relates to an amusement ride such as a roller coaster.

Description of Related Art

Traditional roller coasters have been known for many years. These conventional roller coasters typically have a train of connected vehicles carrying a number of riders. In these roller coasters, riders have a passive ride, with no control over their speed of travel, and no competitive element.

The applicant's earlier U.S. Pat. No. 7,980,181 describes a racing rollercoaster ride in which two riders can race each other to traverse the track. The rider that traverses the track most quickly is determined in part by the rider who most effectively and quickly launches themselves at the start of the race, and who then minimises speed loss due to rolling resistance on corners of the track by means of a steering action that applies a mechanical force to re-align the angular position of the wheel bogies of the carrier with the track. However, such rolling resistance may not of itself result in sufficient frictional force on the corners to cause a noticeable difference in speed between an accurately steered vehicle and an un-steered vehicle.

Other roller coaster rides provide for a rider controlled braking system that allows the rider to choose whether or not to apply the braking system to slow the progress of the coaster. An example of such a ride is that described in U.S. Pat. No. 4,221,170 (Koudelka). In Koudelka a monorail mountain coaster includes a brake lever pivotally mounted to the chassis frame of the vehicle that can be engaged with the channel on which the vehicle is rotatably mounted to create a drag brake effect if the rider wishes to slow the vehicle.

Another example of a mountain coaster is the 'Smoky Mountain Alpine Coaster' located in Pigeon Forge, Tenn., United States of America. That mountain coaster utilises a magnetic braking system that is operable by the rider to slow the vehicle.

In the mountain coaster examples, the braking systems simply allow the rider to slow the vehicle when they feel it is necessary to do so for comfort or safety.

It is an object of at least preferred embodiments of the present invention to provide an amusement ride with a braking system that, in the absence of an action by an occupant, causes a rider carriage to slow at part(s) of the ride, and that enables the rider to take action to minimise or avoid the slowing of the rider carriage, and that goes at least some way to address the above described problem. An additional or alternative object is to provide the public with a useful alternative.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

BRIEF SUMMARY

In accordance with a first aspect of the present invention, an amusement ride is provided. The amusement ride comprises a track having a curved portion; a carriage for holding an occupant that is movable along the track, wherein the carriage is configured such that at least part of the carriage will move in response to at least one inertial force acting upon the carriage as the carriage traverses the curved portion of the track, in the absence of a counteraction by the occupant of the carriage; and a braking system that is configured to operate in response to the movement of at least part of the carriage to induce a braking force to slow travel of the carriage; wherein the braking system is configured, upon an action by the occupant of the carriage to counteract the induction of the braking force, to reduce or substantially avoid the braking force acting on the carriage.

The requirement for the occupant(s) to act to counteract the inertial force-induced braking of the at least part of the carriage, introduces an interactive element to the ride which allows the ride experience to become competitive and hence more enjoyable for the participant. Accordingly, the functioning of the braking system described herein is additional to that which may be used for the safety or comfort of the occupant(s). The braking system described herein may be provided as a separate braking system from the braking system that may be used for the safety or comfort of the occupant(s). Alternatively, the safety or comfort features may be incorporated as additional features into the braking system described herein.

The at least one inertial force may cause the at least part of the carriage to roll and/or pitch and/or yaw (rotational or pivoting movements) and/or to surge and/or sway and/or heave (translational movements).

In an embodiment, the inertial force(s) is/are centrifugal and/or gravitational forces.

In an embodiment, the braking system comprises a first brake component mounted on the track at the curved portion of the track, and a second brake component provided on the carriage. Alternatively, or additionally, the first brake component may be mounted on the track after the curved portion of the track. Mounting the first brake component after, but adjacent to, the curved portion of the track may accommodate delayed triggering of the braking system in response to inertial force-induced movement of the at least part of the carriage.

In an embodiment, the braking system is a magnetic braking system, one of the first and second brake components being a magnetic component and the other of the first and second brake components being a conductive component. In an embodiment, the magnetic component is a permanent magnet that is configured such that, in response to the inertial force-induced movement of the at least part of the carriage, the permanent magnet moves into proximity with the conductive component to slow the travel of the carriage. The braking system may comprise a controller and an actuator such as a hydraulic actuator for example, to cause the permanent magnet to move into proximity with the conductive component.

In an embodiment, the magnetic component comprises an array of magnets. In an embodiment, the array of magnets is configured to induce eddy currents in the conductive component as the conductive component becomes proximate to the magnets, to apply a braking force to the carriage. In an embodiment, the braking force applied to the carriage is dependent on the proximity of the magnets and the conductive component.

In an embodiment, the conductive component is arcuate, and the array of magnets defines a complementary arcuate configuration.

In an embodiment, the braking system is configured to move the first brake component away from the second brake component, upon the action by the occupant to counteract the induction of the braking force, to reduce or substantially avoid the braking force acting on the carriage.

In an embodiment, one of the first and second brake components comprises a conductive fin and the other of the first and second brake components comprises at least one magnet. In an embodiment, the second brake component comprises an array of magnets having a channel to receive the fin. In an embodiment, the array of magnets is configured to induce eddy currents in the fin as the fin travels relative to the magnets, to apply a braking force to the carriage. In an embodiment, the braking force applied to the carriage is dependent on the amount of the fin received by the channel.

In an embodiment, the conductive fin is arcuate, and the magnet array defines a complementary arcuate slot for receiving the fin.

In an alternative embodiment, the first and second components of the magnetic braking system may be generally parallel. The braking force applied to the carriage may depend on the space between the first and second brake components, and/or on the amount of overlap of between the first and second brake components. A smaller gap between the first and second brake components provides a stronger braking force than a larger gap. Similarly, more overlap provides a stronger braking force than a small amount of overlap.

In an embodiment, the magnetic component comprises an electro-magnet that is configured such that, in response to the movement of the at least part of the carriage, the electro-magnet becomes wholly or partly powered to interact with the conductive component to slow the travel of the carriage. The braking system may comprise an electric controller to control the electro-magnet.

In an embodiment, the braking system is configured to cause the electro-magnet to become wholly or partially de-powered, upon the action by the occupant to counteract the induction of the braking force, to reduce or substantially avoid the braking force acting on the carriage. In an embodiment, the action by an occupant to counteract the induction of the braking force may result in the at least partial depowering of the magnetic component (for example, proportional to the extent of counteracting movement of the at least part of the carriage) by means of an electric controller to reduce or substantially avoid the braking force acting on the carriage.

In an embodiment, the braking system is a friction braking system, wherein the braking system comprises a friction braking pad that is configured such that, in response to the inertial force-induced movement of the at least part of the carriage relative to the chassis, the friction braking pad brakes movement of the carriage relative to the track. The braking system may comprise a controller and an actuator such as a hydraulic actuator for example, to control the friction braking system.

In an embodiment, the friction braking pad is configured to operatively engage with, and act upon, part of the track to brake movement of the carriage relative to the track. Alternatively, the friction braking pad may be configured to operatively engage with, and act upon, part of the carriage (e.g. at least one wheel of the carriage), to brake movement of the carriage relative to the track.

In an embodiment, the braking system is configured to cause the friction braking pad to become wholly or partially disengaged, upon the action by the occupant to counteract the induction of the braking force, to reduce or substantially avoid the braking force acting on the carriage.

In an embodiment, the carriage comprises a chassis movably mounted on the track, wherein said at least part of the carriage comprises a part of the carriage that is movably mounted relative to the chassis and is configured to move relative to the chassis in response to the at least one inertial force acting upon the carriage as the carriage traverses the curved portion of the track, in the absence of a counteraction by the occupant.

In an embodiment, the part of the carriage is pivotally mounted relative to the chassis and is configured to pivotally move relative to the chassis in response to the at least one inertial force acting upon the carriage as the carriage traverses the curved portion of the track.

In an embodiment, the part of the carriage is pivotable about a longitudinal, roll axis. In an embodiment, the track curved portion comprises a sideways bend, and pivoting the part of the carriage relative to the chassis about the longitudinal roll axis reduces or substantially avoids the braking force acting on the carriage.

Additionally, or alternatively, the part of the carriage may be pivotable about a lateral, pitch axis. In an embodiment, the track curved portion comprises an upwards or downwards bend, and wherein pivoting the part of the carriage relative to the chassis about the pitch axis reduces or substantially avoids the braking force acting on the carriage.

Additionally, or alternatively, the part of the carriage may be pivotable about a yaw axis perpendicular to the track and chassis. In an embodiment, the track curved portion comprises a twisted portion, and pivoting the part of the carriage relative to the chassis about the yaw axis reduces or substantially avoids the braking force acting on the carriage.

Additionally, or alternatively, the part of the carriage may be slidably mounted relative to the chassis and configured to move with a translational movement relative to the chassis in response to the at least one inertial force acting upon the carriage as the carriage traverses the curved portion of the track.

Additionally, or alternatively, the part of the carriage may be slidable along a longitudinal, surge axis. In an embodiment, the track curved portion comprises an upwards or downwards bend, and wherein sliding the part of the carriage relative to the chassis along the surge axis reduces or substantially avoids the braking force acting on the carriage.

Additionally, or alternatively, the part of the carriage may be slidable along a lateral, sway axis. In an embodiment, the track curved portion comprises a sideways bend, and sliding the part of the carriage relative to the chassis along the sway axis reduces or substantially avoids the braking force acting on the carriage.

Additionally, or alternatively, the part of the carriage may be slidable along a substantially vertical, heave axis. In an embodiment, the track curved portion comprises a twisted portion, and sliding the part of the carriage relative to the chassis along the heave axis reduces or substantially avoids the braking force acting on the carriage.

It will be apparent to those skilled in the art that it is possible by a combination of one or more of these functionalities to configure the carriage so that the at least part of the carriage may experience up to six degrees of freedom of movement as the carriage traverses curved portions of the track, thereby increasing the potential involvement of the occupant, responsive to the movements, to reduce or substantially avoid the braking force acting on the carriage.

The carriage may comprise a mechanical device to move or assist in moving the part of the carriage relative to the chassis. For example, the mechanical device may comprise one or more actuators that are operable by a user to move or assist in moving the part of the carriage relative to the chassis.

In an embodiment, the carriage comprises one or more biasing devices that bias the part of the carriage towards a centred position.

In an embodiment, the part of the carriage that is movably mounted relative to the chassis and that is configured to move relative to the chassis in response to the at least one inertial force acting upon the carriage as the carriage traverses the curved portion of the track, in the absence of a counteraction by the occupant, comprises a carrier for holding an occupant, the carrier being movably mounted relative to the chassis, wherein the carrier is configured to move relative to the chassis in response to the at least one inertial force acting upon the carriage as the carriage traverses the curved portion of the track, in the absence of a counteraction by an occupant. The carrier may be configured to hold one or more occupants.

In an embodiment, the carriage comprises one or more biasing devices that bias the carrier towards a centred position on the chassis.

The action by the occupant to counteract the induction of the braking force may comprise an action to counteract the movement of the carrier relative to the chassis, wherein the braking system is responsive to the action to counteract the movement of the carrier relative to the chassis, to reduce or substantially avoid the braking force acting on the carriage. In an embodiment, the carrier is configured to move relative to the chassis in response to the at least one inertial force acting upon the carriage as the carriage traverses the curved portion of the track, in the absence of an action by an occupant to counteract the movement.

In an embodiment, the action to counteract the movement of the carrier relative to the chassis comprises the occupant physically moving the carrier relative to the chassis. In an embodiment, the carrier is movable relative to the chassis by way of the occupant shifting their weight to move the position of a combined centre of mass of the carrier and occupant relative to the chassis.

In an embodiment, the carriage comprises a weight compensating feature to minimise changes in braking force and speed of the carriage for different mass occupants. In an embodiment, the height of the occupant relative to the chassis is adjustable to move the height of the combined centre of mass relative to the track. Alternatively, in an embodiment the braking force applied to the carriage may be increased or reduced.

In addition to, or alternatively to, the carrier, said at least part of the carriage may comprise an articulated section of the carriage that is operable by an occupant, the articulated section being movably mounted relative to the chassis, wherein at least part of the articulated section is configured to move relative to the chassis in response to the at least one inertial force acting upon the carriage as the carriage traverses the curved portion of the track, in the absence of a counteraction by an occupant.

In an embodiment, the articulated section of the carriage may comprise a forward part of the carriage. The articulated section of the carriage may comprise a handlebar section of the carriage. The handlebar section of the carriage may be movable independently of the carrier. The entire articulated section including the handlebar section, may be configured to move together in response to the at least one inertial force acting upon the carriage as the carriage traverses the curved portion of the track. Alternatively, the handlebar section may be configured to move at least partly independently of the remainder of the articulated section.

Additionally, or alternatively, the articulated section may comprise a different portion of the carriage. For example, the articulated section may comprise a foot-operated part of the carrier that is articulated relative to the chassis and/or carrier.

In an embodiment, the carrier and/or the articulated section may be pivotable about a longitudinal, roll axis and/or a lateral, pitch axis and/or a vertical yaw axis. Alternatively, or additionally, the carrier and/or the articulated section may be slidable along a longitudinal surge axis and/or a lateral sway axis and/or a substantially vertical heave axis.

In an embodiment, the action by the occupant to counteract the induction of the braking force comprises an action to counteract the movement of the at least part of the articulated section relative to the chassis, wherein the braking system is responsive to the action to counteract the movement of the at least part of the articulated section relative to the chassis, to reduce or substantially avoid the braking force acting on the carriage. In an embodiment, the action to counteract the movement of the at least part of the articulated section relative to the chassis comprises the occupant physically moving the at least part of the articulated section relative to the chassis.

In such an embodiment, the requirement for the occupant(s) to act to counteract the inertial force-induced movement of the at least part of the carriage, and thereby apparently steer the carriage through the curved portion(s) of the track, introduces an interactive element to the ride which allows the ride experience to become competitive and hence more enjoyable for the participant.

In an embodiment, the handlebar section is movable relative to the carrier by an occupant who may physically pivot and/or slide the handlebar section. Alternatively, or additionally, the carriage may comprise a mechanical arrangement operable by an occupant, such as a hydraulic actuator, to facilitate the movement of the handlebar section.

In an embodiment, the track curved portion comprises a sideways bend, and wherein pivoting the carrier and/or the handlebar section relative to the chassis about the longitudinal, roll axis as the carriage traverses the bend reduces or substantially avoids the braking force acting on the carriage.

In an embodiment, the track curved portion comprises an upwards or downwards bend, and wherein pivoting the carrier and/or the handlebar section relative to the chassis about the lateral, pitch axis as the carriage traverses the bend reduces or substantially avoids the braking force acting on the carriage.

In an embodiment, the track curved portion comprises a twisted portion, and wherein pivoting the carrier and/or the handlebar section relative to the chassis about the vertical, yaw axis as the carriage traverses the bend reduces or substantially avoids the braking force acting on the carriage.

In an embodiment the carrier and/or the handlebar section may be slidingly translatable along at least one of the surge, sway, and heave axes. In such embodiment the centrifugal or gravitational forces acting on the carriage will result in one or more surge, sway and heave movements on the carrier, and/or the handlebar section and/or articulated section, as the carriage traverses curved portions of the track, each of which will induce a braking force.

In an embodiment, the action by the occupant to counteract the induction of the braking force comprises an action to counteract the movement of the at least part of the carriage, and thereby reduce or substantially avoid the braking force acting on the carriage. Upon an action by an occupant of the carriage to counteract the movement of the at least part of the carriage, the braking force acting on the carriage is reduced or substantially avoided. Such action may comprise the occupant physically moving the at least part of the carriage to cause one brake component to move from the proximity of the other brake component. In an embodiment, the carrier is movable by an occupant of the carriage relative to the chassis to move the first brake component away from the second brake component to reduce or substantially avoid the braking force acting on the carriage.

Alternatively, or additionally, the action by the occupant to counteract the induction of the braking force may comprise interaction with a user interface that is operatively coupled with the braking system, wherein the interaction with the user interface reduces or substantially avoid the braking force acting on the carriage. In an embodiment, the user interface may be connected to or form part of a controller, operable by the occupant in response to the rotational and/or translational movements of the at least part of the carriage, and configured to enable the occupant(s) to at least partly override the induction of the braking system and thereby reduce or avoid the braking effect on the carriage. The controller may be integrated with, or connected to, the braking system controller. Such an action may be in addition to or as an alternative to the movement of the at least part of the carriage to counteract the at least one inertial force acting on the carriage. For example, it may be necessary for an occupant to both move the at least part of the carriage to counteract the inertial force-induced movement, and interact with the user interface, to obtain optimum speed of the carriage through the curved portions of the track.

The user interface may, for example, comprise one or more buttons or switches (either physical or formed on a touchscreen) for an occupant to actuate, wherein actuation of at least one of the buttons or switches causes the braking system to be at least partly overridden or disengaged.

In an embodiment, the user interface may comprise a plurality of buttons or switches, with each button or switch corresponding to a respective one of the degrees of freedom that will be encountered as the carrier traverses curved portion(s) of the track, and that will cause the braking system to slow the travel of the carriage. In such an embodiment, the occupant may need to press the correct button(s) or switch(es) that correspond(s) to an inertial force that is causing movement of the at least part of the carriage, to at least partly override or disengage the braking system on that curved portion of the track.

Additionally, or alternatively, the user interface may be suitably connected to a controller and actuator(s), such that pressing the button(s) or switch(es) causes physical movement of the at least part of the carriage, to counteract the inertial force-induced movement of the at least part of the carriage. Each button or switch may again correspond to a respective degree of freedom, with correct actuation of that button or switch causing a movement of the at least part of the carriage to counteract the inertial-force induced movement.

Accordingly, alternatively, or additionally, the action by the occupant to counteract the induction of the braking force may comprise interaction with a user interface that is operably coupled with a controller and actuator(s), wherein the interaction with the user interface causes physical movement of the at least part of the carriage, to counter the inertial force-induced movement of the at least part of the carriage, wherein the interaction with the user interface reduces or substantially avoids the braking force acting on the carriage.

The curved portion of the track may comprise a sideways, upwards, or downwards bend, or may comprise a twist. Alternatively, the curved portion may comprise a combination of sideways curvature, vertical curvature, and/or twist curvature. The track may be banked. In an embodiment, the track comprises a plurality of curved portions, and the braking system may be configured to operate as the carriage traverses at least one of the curved portions. For example, at least one of the curved portions may comprise first brake component(s). Alternatively, or additionally, the braking system may be configured to operate after the carriage has traversed at least one of the curved portions, to allow for actuation delay of the braking system. The curved portions may have the same or varying types and degrees of curvature. The braking system may be configured to operate as the carriage traverses at least some of the curved portions, and/or after the carriage has traversed at least some of the curved portions.

In an embodiment, movement of the at least part of the carriage in response to the at least one inertial force on the carriage may be detected by means of at least one sensor positioned on the carriage. The at least one sensor may be configured to detect one or more of the rotational movements and/or the translational movements of the at least part of the carriage. In an embodiment, a controller is connected to the at least one sensor, and is configured to process information as to the extent of the movement of the at least part of the carriage from the at least one sensor. In an embodiment, the controller will control the actuation of the braking force to be applied to the carriage or to the track to correspond proportionately to the extent of the movement of the at least part of the carriage. In this manner, the action of the occupant(s) of the carriage to correct the movement of the at least part of the carriage will proportionately reduce or avoid the braking force acting on the carriage.

In an embodiment, the carriage may include a single magnet, or a single array of magnets configured to respond to one or more sensors detecting one or more of the rotational movements, and/or one or more of the translational movements, of the at least part of the carriage. The response of the single magnet, or single array of magnets, to the one or more sensors will induce a braking effect to slow the progress of the carriage. A benefit of using a single magnet/array of magnets, is that the same magnet/array of magnets may be actuated in response to sensors detecting the roll, pitch, or yaw movements.

In an embodiment, the ride comprises a launch system for launching the carriage along the track from a stationary start position.

In an embodiment, the carriage is movably engaged with the track by way of a plurality of wheels. In an embodiment having a carriage chassis, the wheels may be mounted to the chassis. The carriage may be positioned above the track or may be suspended below the track.

In an embodiment, the amusement ride comprises two or more tracks and two or more respective carriages movably mounted on the tracks. In such an embodiment, occupants in carriages on separate tracks can race each other. The occupant(s) who best take action to counteract the induction of the braking force, reduce or substantially avoid braking forces acting on the carriage in the track curved portion(s) and move along the track faster. For example, the occupant(s) who manoeuvre their respective carriage to counteract the inertial force-induced movement of at least part of the carriage, for example by successfully shifting their weight to pivot their respective carrier, reduce or substantially avoid braking forces acting on the carriage in the track curved portion(s) and move along the track faster.

The amusement ride may be any type of track-type ride, for example a roller coaster ride. The ride may simulate a luge, skeleton, toboggan, bobsled, racing car, or plane ride or race for example.

In an embodiment, the amusement ride comprises an augmented reality or virtual reality system. In this embodiment, the occupant(s) may appear to race a virtual opponent.

In accordance with a second aspect of the present invention, an amusement ride is provided. The ride comprises a track having a curved portion; a carriage for holding an occupant that is movable along the track, wherein the carriage is configured such that at least part of the carriage will move in response to at least one inertial force acting upon the carriage as the carriage traverses the curved portion of the track, in the absence of an action by the occupant of the carriage to counteract the movement; and a braking system that is configured to operate in response to the movement of the at least part of the carriage to induce a braking force to slow travel of the carriage. The braking system is configured, upon an action by the occupant of the carriage to counteract the movement of the at least part of the carriage, to reduce or substantially avoid the braking force acting on the carriage.

In an embodiment, the action by the occupant comprises physically moving the at least part of the carriage to counteract the movement of the at least part of the carriage, to thereby reduce or substantially avoid the braking force acting on the carriage.

The amusement ride of the second aspect may have any one or more of the features outlined in relation to the first aspect above.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

As used herein the term '(s)' following a noun means the plural and/or singular form of that noun.

As used herein the term 'and/or' means 'and' or 'or', or where the context allows both.

The invention consists in the foregoing and also envisages constructions of which the following gives examples only.

BRIEF DESCRIPTION OF THE FIGURES

The present invention will now be described by way of example only and with reference to the accompanying drawings in which:

FIG. 14(*ii*) is a rear elevation view similar to FIG. 14(*i*), but with the occupant partly counteracting the inertial forces while traversing a left hand bend;

FIG. 14(*iii*) is a rear elevation view similar to FIG. 14(*ii*), but with the occupant not counteracting the inertial forces while traversing a left hand bend;

DETAILED DESCRIPTION OF VARIOUS EMBODIMENTS

The following section describes exemplary embodiments of the present invention. Each described embodiment comprises an amusement ride comprising a track 15, 115 having a curved portion, and a carriage 1, 101 for holding an occupant 7, 107 that is movable along the track. The carriage 1 is configured such that at least part of the carriage will move in response to at least one inertial force acting upon the carriage as the carriage 1, 101 traverses the curved portion of the track 15, 115, in the absence of a counteraction by an occupant. The amusement ride comprises a braking system that is configured in response to the movement of the at least part of the carriage to induce a braking force to slow travel of the carriage. The braking system is configured, upon an action by an occupant 7, 107 of the carriage to counteract the induction of the braking force, to reduce or substantially avoid the braking force acting on the carriage 1, 101.

The braking force provided by the braking system, that is reduced or substantially avoided upon the action by the occupant 7, 107 of the carriage 1, 101, is in addition to the normal rolling resistance of the carriage 1, 101 on the track 15, 115.

The action by the occupant to counteract the induction of the braking force may comprise an action to counteract the inertial force-induced movement of the at least part of the carriage. In such an embodiment, upon an action by an occupant of the carriage to counteract the movement of the at least part of the carriage, the braking force acting on the carriage is reduced or substantially avoided. Such action may comprise the occupant physically moving the at least part of the carriage to cause one brake component to move from the proximity of the other brake component.

Alternatively, or additionally, the action by the occupant to counteract the induction of the braking force may comprise interaction with a user interface that is operatively coupled with the braking system of the carriage, wherein the interaction with the user interface reduces or substantially avoids the braking force acting on the carriage. In an embodiment, the user interface may be connected to or form part of a controller, operable by the occupant in response to the rotational and/or translational movements of the at least part of the carriage, and configured to enable the occupant(s) to at least partly override the induction of the braking system and thereby reduce or avoid the braking effect on the carriage.

Figure 1:
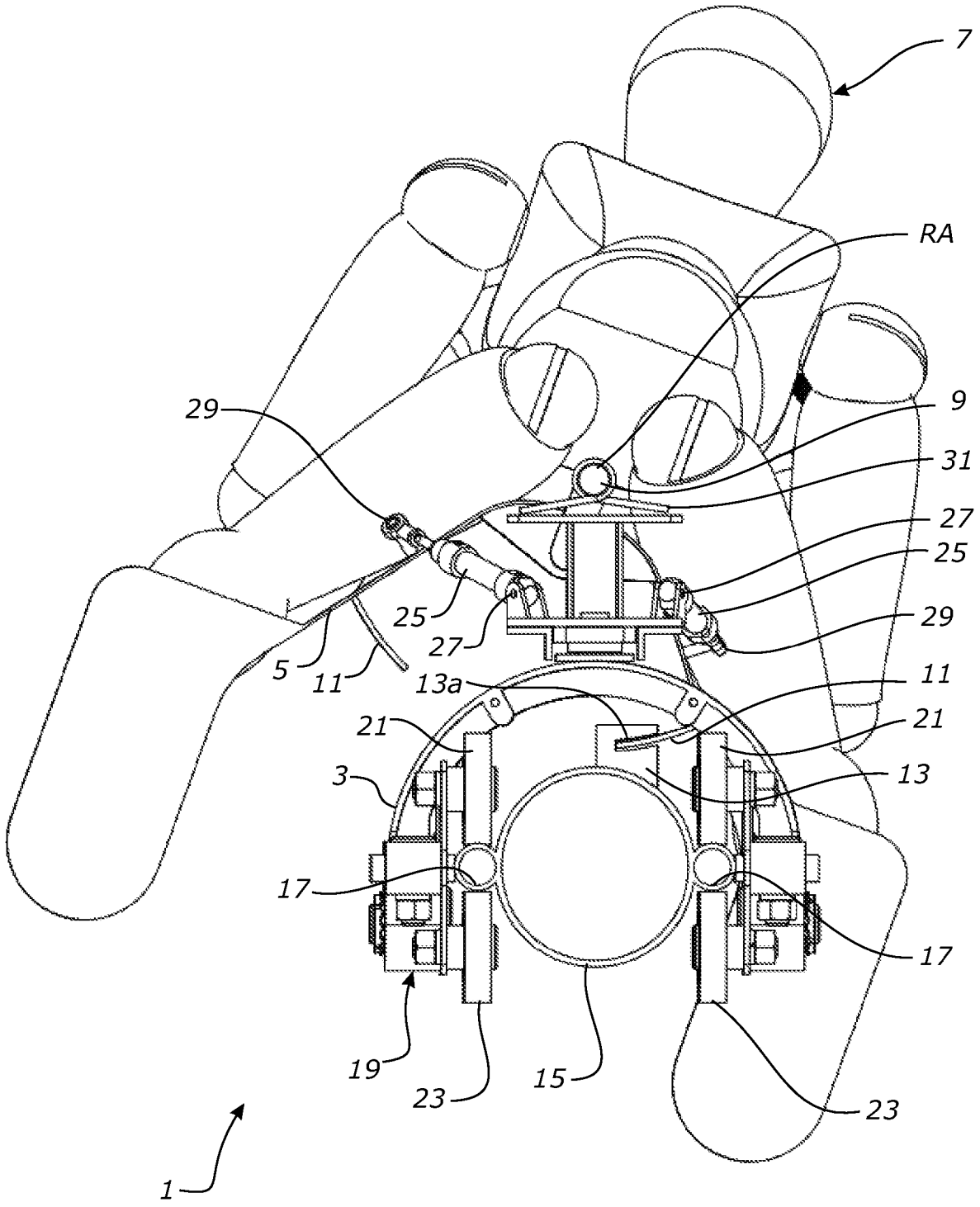
FIG. 1 is a rear elevation view of an occupant on the carriage of an exemplary embodiment of the invention leaning to the right on an unbanked corner.

FIG. 1 shows an exemplary embodiment amusement ride carriage 1 mounted to an exemplary embodiment track 15. The carriage 1 comprises a chassis 3 with a plurality of wheel assemblies 19 that movably couple the carriage 1 to the track 15. The carriage 1 has a carrier 5 for holding an occupant 7.

Figure 11:
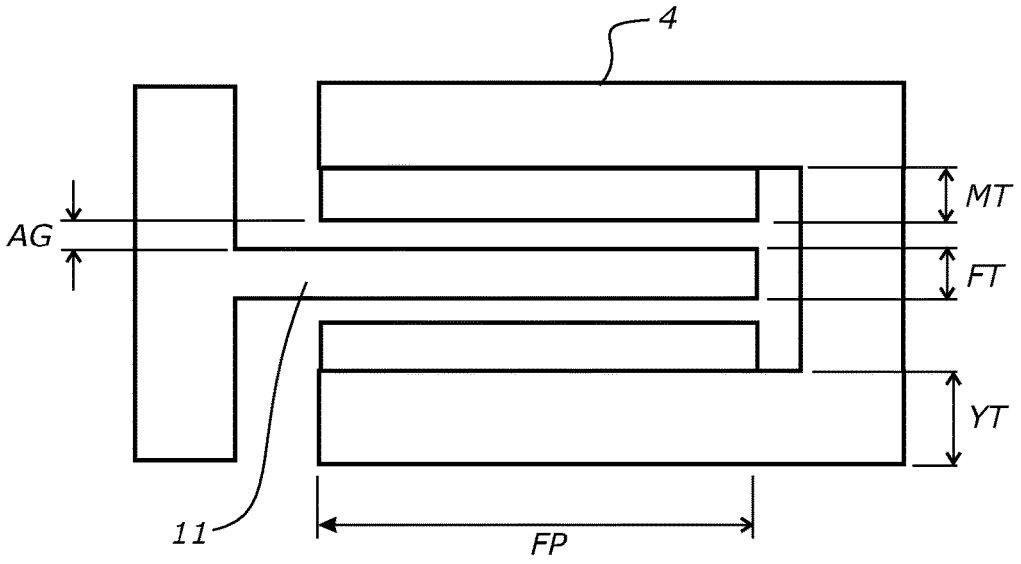
FIG. 11 is a schematic front or rear view corresponding to FIG. 10.

The main track 15 is a tubular member with two tubular side tracks 17 that the wheel assemblies 19 run along. The track 15 comprises at least one corner or bend, and preferably a plurality of bends, as is typical for a roller-coaster type amusement ride. FIG. 11 shows an exemplary embodiment track that includes a number of bends in the track, with a plurality of carriages 1 travelling along the track 15.

Figure 3:
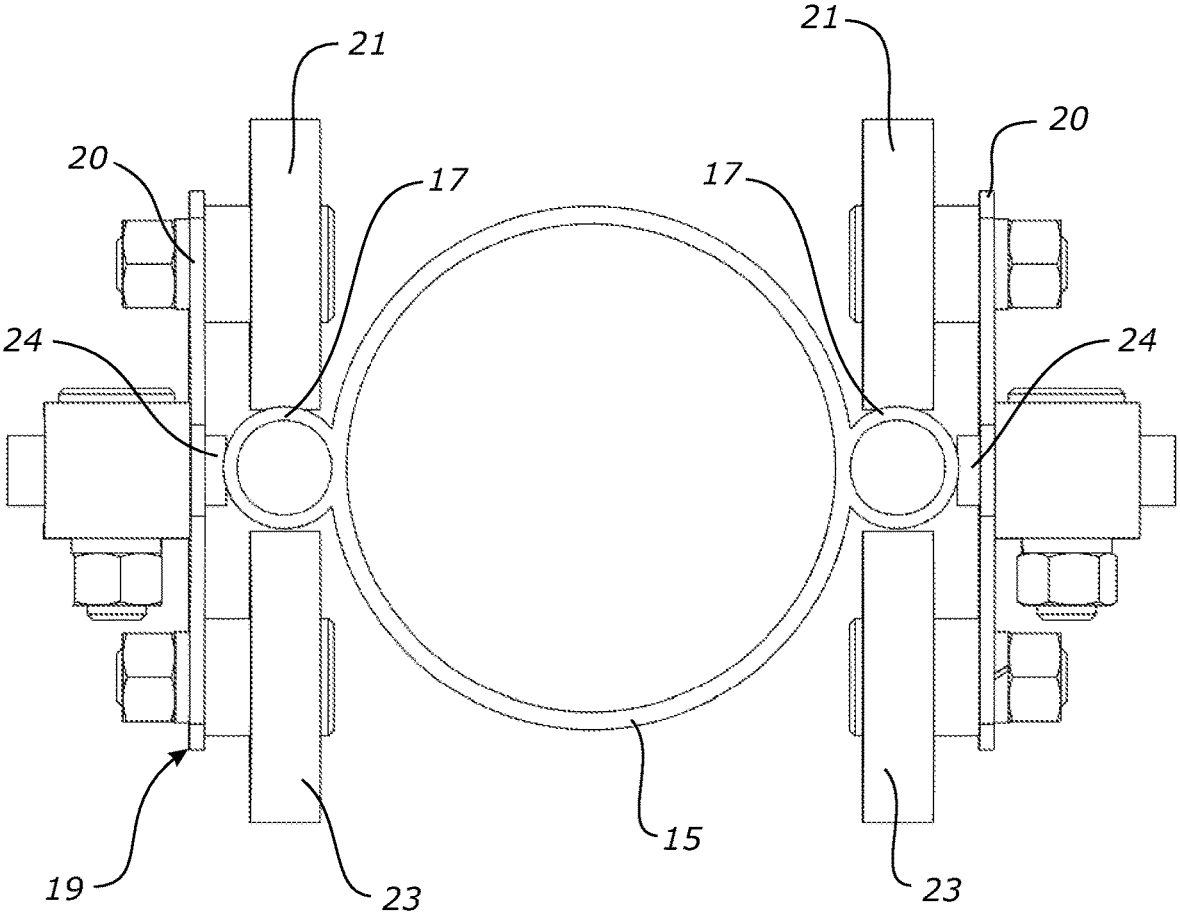
FIG. 3 is a front elevation view of left and right wheel assemblies of the carriage mounted to the track.

Exemplary embodiment left and right wheel assemblies 19 are shown in FIG. 3. The wheel assemblies 19 each have at least one upper wheel 21 configured to roll along an upper surface of a respective side track, track, or lip 17, and at least one lower wheel 23 configured to roll along an opposite, lower surface of a respective side track, track, or lip 17. The wheel assemblies 19 further comprise at least one lateral roller, bearing surface, or wheel 24 to keep the upper and lower wheels 21, 23 positioned on the side tracks 17. The upper, lower, and side wheels 21, 23, 24 are rotatably mounted to a carrier member 20 which is fixed to the chassis 3. The left and right wheel assemblies 19 are mirror images of each other.

The lateral rollers, bearing surfaces, or wheels 24 take side forces acting on the carriage as the carriage travels around a bend.

The wheel assemblies 19 described and shown represent just one possible embodiment, and different wheel assemblies that enable the carriage to slide along the track 17 may be used. The carriage 1 preferably comprises left and right front wheel assemblies 19 at both the front and rear of the carriage 1. However, the carriage 1 may comprise only one left and one right wheel assembly 19. Alternatively, depending on the nature and curvature of the track 15 and the configuration of the wheel assemblies, the carriage 1 may comprise only a single wheel assembly.

Similarly, the track 15 that is described and shown is just one possible embodiment, and different tracks may be used. For example, the side tracks 17 may instead comprise a track, lip, or other side projection or wheel guide to orientate the carrier on the track 15. The main track 15 may have a non-circular cross section, and the wheel assemblies 19 may run directly on the main track 15, or the carriage 1 may be configured or arranged to slidingly engage with less or more than two side tracks 17, and the configuration of the wheel assembly(s) 19 will differ accordingly.

Figure 2:
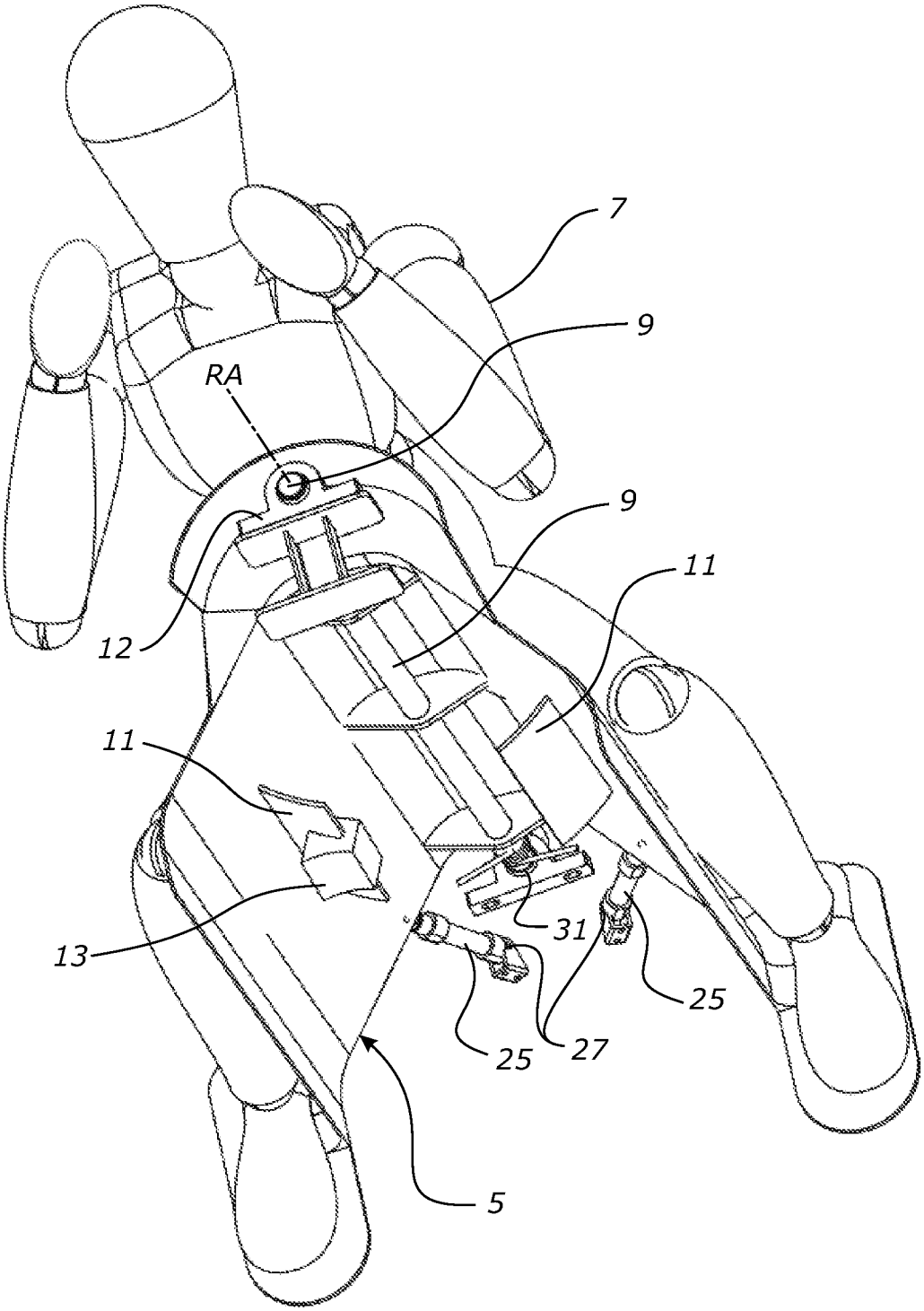
FIG. 2 is a front underside perspective view of the carrier holding an occupant, with the carriage chassis and handlebar hidden.

The carrier 5 is pivotable relative to the chassis 3 about a longitudinal roll axis RA. With reference to FIG. 2, an underside of the carrier 5 comprises a fixed shaft 9. The shaft 9 is pivotably mounted to the chassis 3 at its ends by two roller bearings 12 such that the shaft 9 is rotatable relative to the chassis 3 to define the longitudinal roll axis RA. The carrier 5 is a saddle-type member that an occupant 7 straddles in a prone position.

The occupant 7 is secured to the carriers with a harness, straps, or other supports (not shown). The carriage 1 comprises a handle bar 33 (FIG. 4) that is independent of the carrier 5 and connected to the chassis 3, which the occupant holds for support. The handle bar 33 may be fixed to the chassis 3, or may be pivotable forward and rearward relative to the chassis (FIG. 6) about the roll axis RA. The occupant can use the handle bar to help tilt the carrier 5 relative to the chassis 3. For example, by reacting against the occupant to assist with the transfer of their weight from side to side.

Torsion springs 31 are attached between the shaft 9 and the chassis 3 to bias the carrier 5 to a central position to provide resistance against rolling of the carrier 5 relative to the chassis 3. Air dampers 25 in the form of pneumatic cylinders are connected between the carrier 5 and the chassis, with a first end 27 of each damper 25 pivoted to the chassis 3 and a second end of each damper 25 pivoted to the carrier 5. The stroke length of the damper cylinders 25 limits the magnitude of possible sideways roll between the carrier 5 and the chassis 3. The dampers 25 also smooth the rolling motion and minimise or eliminate overshoot to prevent the occupant from bouncing side to side under the action of the torsion springs 31.

In this embodiment, the braking system comprises a magnetic braking system. The underside of the carrier 5 comprises two downwardly and inward extending fins 11 attached to the carrier 5 on opposite sides of the pivot 9. The fins 11 comprise an electrically conductive material. The curved sections of the track 15 each comprise one or more complementary permanent magnets 13 on the top of the track 15, towards one side of the track, with a slot 13*a* for receiving a respective one of the fins 11. When the fin is positioned in the slot, the magnet 13 applies a braking force to the carriage to slow its travel along the track and through the bend. The magnitude of the braking force depends on the length of the fin 11 that is positioned in the slot 13*a*. The fins 11 and magnets 13 provide a braking system which, in a default mode and in the absence of an action of an occupant to counteract inertial force-induced movement of at least part of the carriage, is configured to operate in response to at least one inertial force acting upon the carriage as the carriage 1 traverses the curved portion of the track 15 inducing a braking force to slow travel of the carriage.

The time-varying magnetic field generated by the magnets 13 on the top of the track 15 induce circular electric currents within the fin 11. These eddy currents produce their own magnetic fields that oppose the magnetic field that originally created them. This phenomenon can be exploited to create a frictionless braking system in which the braking force is proportional to velocity.

The side of the track 15 that the permanent magnet 13 is positioned towards depends on the track bend directionality and is selected so that fin 11 will be positioned in the slot 13*a* when the carriage 1 moves through the corner and the carrier and occupant roll due to inertial forces. As the carriage 1 enters a curved section of the track 15, the dynamic or inertial forces will cause the carrier 5 carrying the occupant to roll away from the curve. This rolling motion will cause the conducting fin 11 to come into proximity of a magnetic field created by the magnets 13 on the track, which will slow the speed of the carriage 1 around the curve. This is a passive system which does not require power or any input from the occupant or vehicle to operate and there is no contact between components on the vehicle or track.

Magnetic braking also has the advantage of reducing wear on components and produces no noise. However, the build-up of eddy currents in the conducting fin 11 must be dissipated as heat and the braking effect is reduced as the conductor heats up.

In the example shown in FIG. 1, the occupant is taking a left-hand unbanked corner such that the dynamic or inertial forces act to push the occupant and carrier 5 away from the curve to the occupant's right. The carrier 5 rolls clockwise (from the point of view of the occupant) and the right fin 11 passes through a magnetic field generated by the permanent magnet or magnets 13 towards a right of the track 15, as shown, to slow the carriage 1.

To keep the speed of the carriage 1 as fast as possible, the occupant 7 can act to counteract the induction of the braking force. In this embodiment, the occupant 7 can minimise or prevent this braking force by tilting the carrier 5 into the corner (i.e. anticlockwise from the point of view of the occupant) to counteract the inertial forces. The occupant can tilt the carrier relative to the chassis 3 by shifting their weight into the corner and/or by pushing against the handlebar 33 to tilt the carrier 5 into the corner. It the occupant does not actively shift their position to lean into a bend or push against the handlebar 33, the carriage 1 will experience a speed penalty. This simulates a steering effect, enhancing the participation of the occupant.

In the embodiment shown, the fins 11 are arcuate members and are positioned such that they trace the arc of a circle about the carrier 5 pivot 9. The magnet slot 13*a* has a corresponding shape. This means that more of the conducting fin 11 is exposed to the magnetic field of the permanent magnet 13 the further out of the corner the carrier is permitted to roll. Alternatively the brake system may comprise planar magnets and a planar fin.

In the embodiment shown, the carrier 5 can tilt at an angle of about 20° left or right about the roll axis 9. If the occupant does not intervene to correct their position and leans over at the maximum 20° angle, they will experience the maximum braking force and consequently the greatest penalty to their speed. If they manage to shift their weight appropriately to fully counteract the inertial forces and bring the carrier 5 to a neutral horizontal position or beyond, they will incur zero speed penalties. If they only manage to shift their weight sufficiently to partly counteract the inertial forces (i.e. so that the carrier is positioned at an intermediate angle between that of FIG. 1 and a horizontal position) a braking force will still be applied by the braking system. But that braking force will be less than the maximum braking force, so a smaller speed penalty bill be suffered.

In the arrangement of FIGS. 1 and 3, the carrier 1 is traversing a left-hand unbanked corner, a side force acts on the left side wheel 24 of the chassis and is reacted by the track 15 to balance the centrifugal force created from the carriage 1 travelling around the bend. All centripetal force must be supplied by this side force. Hence, the side force is equal to the centripetal force and is calculated by the equation:

$$F = \frac{mv^2}{r}$$

Where: m is the combined mass of the carrier 1 and the occupant, v is the velocity or the carrier 1, and r is the radius of the corner.

For high velocities and tight bends, the force on the inner side wheel 24 will be extremely high and possibly unsafe. Larger side wheels can handle greater loads but larger bearings, bushes and members create larger, heavier and more expensive vehicle and are undesirable. The high centrifugal force felt by the occupant will be unpleasant. As the force increases, there is a greater feeling of being thrown out of the curve.

However, for a given curve of the track 15 and carrier 1 velocity, there will be an ideal bank angle to minimise loading on the side wheels 24 due to centripetal force, and to maximise occupant comfort.

Figure 4:
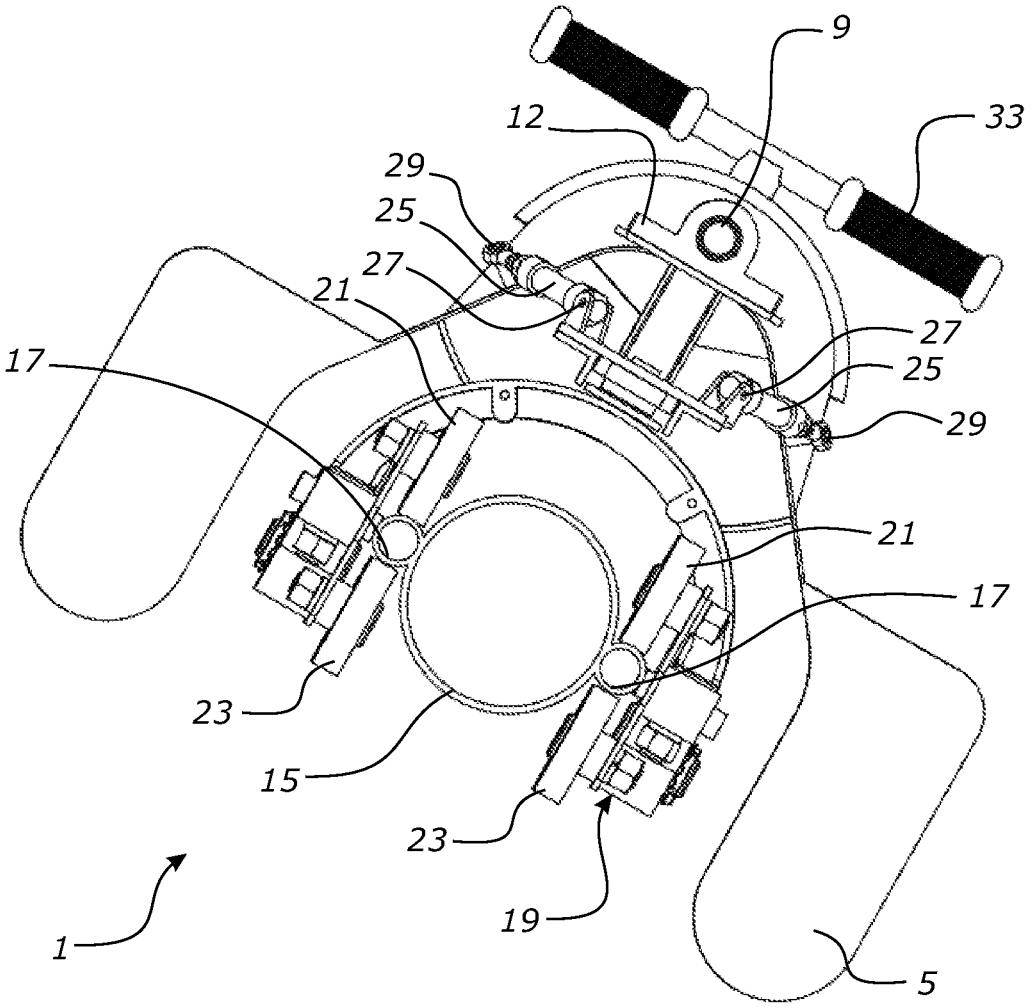
FIG. 4 is a rear elevation view of the carriage in a neutral position on a banked corner.
Figure 5:
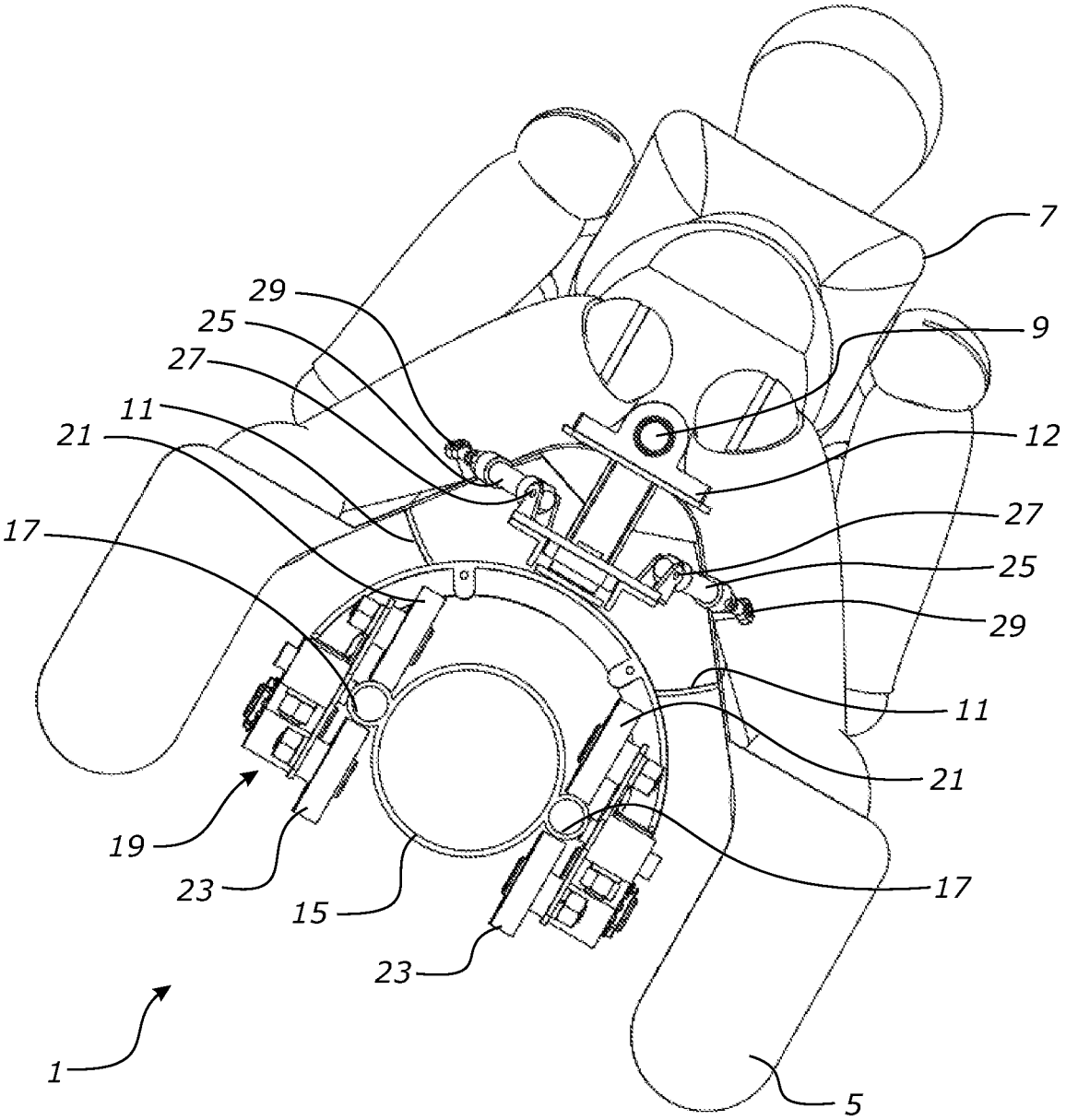
FIG. 5 is the view of FIG. 4, but with an occupant positioned on the carrier.

FIG. 4 shows the carriage 1 travelling into a right-hand bend that is banked at an ideal angle for the carriage velocity.

In this ideal situation, the resultant of the centrifugal and weight forces acts parallel to the upper and lower wheels 21, 23. All of the loading is taken by these upper and lower wheels 21, 23; the side wheels 24 do not take any load. If the carriage speed is constant throughout the corner and there is no magnetic braking, the side wheels 24 are theoretically not required to keep the carriage 1 on the track 17 for that specific banking angle.

In an ideally banked corner, all of the resultant forces are directed normal to the angle of the track 15, so the occupant will feel a sensation of being forced down into the carrier saddle, but will not experience a lateral force pushing them to one side. The ideal bank angle θ for a given curve of a constant radius r and carriage velocity v can be calculated:

$$\theta = \tan^{-1}\left(\frac{v^2}{rg}\right)$$

Where g is acceleration due to gravity. However, in practice, the velocity of the carriage 1 will change due to friction as the carriage travels through the bend. A side force will develop even if the carriage enters the bend at the 'ideal' velocity.

The tilt braking described above would not be as effective in well banked corners because the occupant would not experience a centrifugal force pushing them towards the outside of the bend. The mass of the occupant above the carrier pivot 9 could create a torque sufficient to cause the carrier 3 to roll in towards the curve, which would be counter-intuitive. In addition, the sideways forces experienced by an occupant contribute to the thrill of the amusement ride.

Therefore, it is desirable to bank bends in the track 15 to some extent to reduce wear on components and ensure some occupant comfort, but to under-bank the bends compared to the ideal bank angle to retain the thrill of the ride and allow the tilt braking to engage.

The carriage may comprise a mechanical device to move or assist in moving the part of the carriage relative to the chassis. For example, the mechanical device may comprise one or more actuators that are operable by a user to move or assist in moving the part of the carriage relative to the chassis. In one form, the handlebar 33 may be operatively connected to the chassis 3 and to the carrier 5, and configured such that movement of the handlebar 33 by the occupant moves or assists with moving the carrier 5 relative to the chassis 3, to counteract the inertial force-induced movement of the carrier 5. The handlebar 33 could be used instead or, or in addition to, an occupant shifting their weight on the carrier 5.

Alternatively, or additionally, the carriage 1 may comprise pitch, yaw, sway, heave and/or surge steering to counteract inertial force-induced movement of at least part of the carriage and thereby counteract the induction of the braking force.

Generally, the movement of at least part of the carriage in response to the inertial force may be detected by a suitable sensor(s). For example, with reference to FIG. 7 and also to FIG. 16, the at least part of the carriage comprises an articulated section of the carriage. The articulated section may comprise a forward part of the carriage, and in the form shown, comprises a handlebar section of the carriage. Additionally, or alternatively, the articulated section may comprise a different portion of the carriage. The articulated section comprises a handlebar 33. Inertial force(s) applied to the handlebar 33, as the carriage traverses a curved portion of the track, will cause the handlebar 33 to move, in the absence of counteraction by the occupant of the carriage. The handlebar 33 may be provided with one or more of a roll sensor 153, a pitch sensor 155, a yaw sensor 157, a sway sensor 158, a heave sensor 159, or a surge sensor 160 which are connected to a controller 151 as described in more detail below. The handlebar may be configured to pivot about, and/or slide along, any of the respective axes. The handlebar will be configured to move in response to the inertial force(s), in the absence of counteraction by an occupant of the carriage. The handlebar may comprise a mass that is positioned to enhance the movement of the handlebar in response to the inertial force(s).

The controller 151 is connected to a braking system actuator 111*c*. The sensor(s) will indicate when inertial force-induced movements are applied to the handlebar 33, and the magnitude of those forces. In response to the indication of forces, the sensor(s) will cause an actuator 111*c* to move a magnet 111 into proximity with the conductive rail 113. The extent of that movement will depend on the magnitude of the inertial force-induced movement.

Figure 7I:
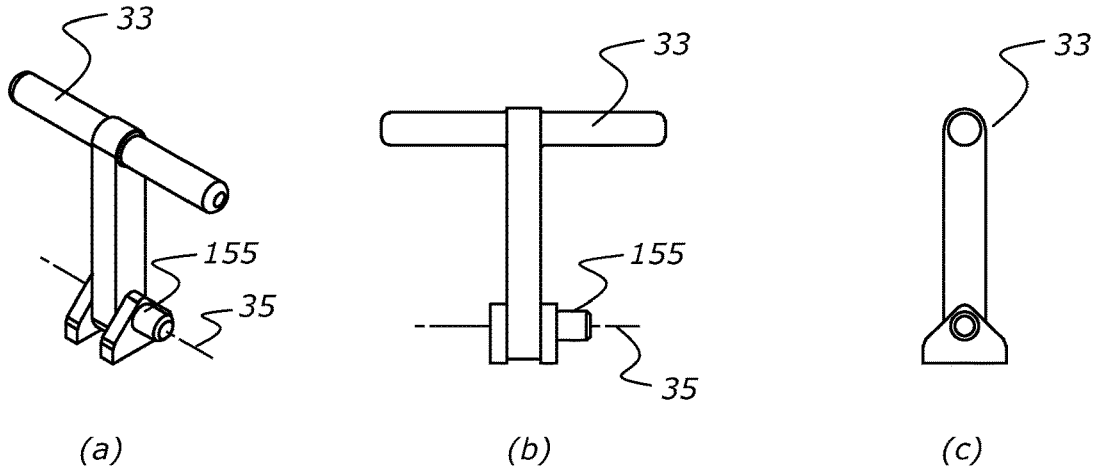
FIGS. 7(*i*) to 7(*iii*) are schematic views showing a handlebar which is pivotable to change the magnetic braking force applied to an embodiment of the carriage, where FIGS. 7(*i*) (a)-(c) show the handlebar in a neutral position in which inertial forces applied the handlebar have been fully counteracted by an occupant, FIGS. 7(*ii*) (a)-(c) show the handlebar in an intermediate position in which inertial forces have be partly counteracted by an occupant, and FIGS. 7(*iii*) (a)-(c) show the handlebar in a position in which the inertial forces have not been counteracted by an occupant.
Figure 7:
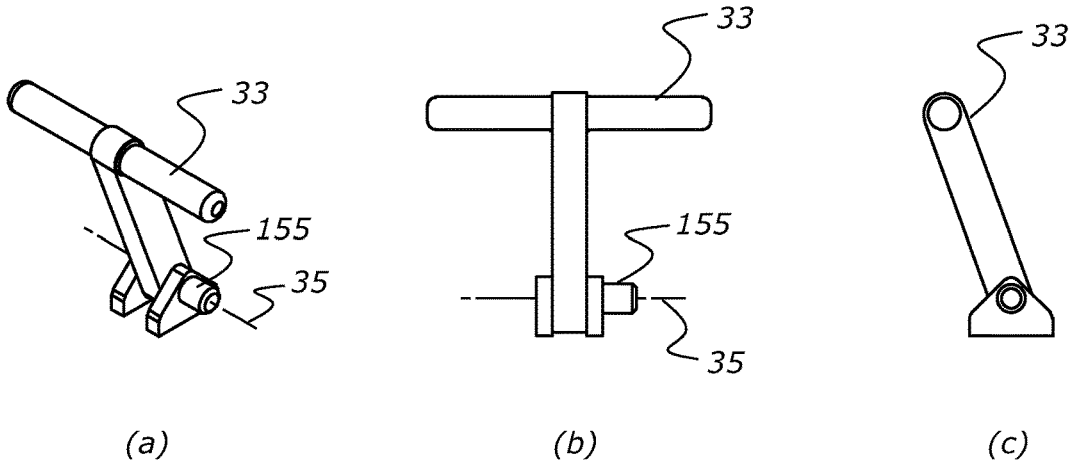

For example, with reference to FIGS. 7(*i*) to 7(*iii*), the handlebar 33 may be pivotable relative to the chassis 3, about a lateral, pitch axis 35. The occupant(s) may use the handlebar 33, which is pivotable forward and rearwards, to counteract inertial force-induced pitch movement of the handlebar relative to the chassis. The handlebar 33 is preferably biased by biasing member(s) such as torsion spring(s) (not shown) to a neutral position relative to the chassis.

For example, in the position shown in three perspectives in FIG. 7(*iii*) (a)-(c), the occupant has not counteracted the inertial forces applied to the handlebar 33. Therefore, the inertial force-induced movement applied to the handlebar 33 is a maximum (shown in this example as approximately 40 degrees of rearward tilt). The pitch sensor 155 detects that maximum movement, and the controller 151 causes the actuator 111*c* to move the magnet 111 downwards a maximum distance, bringing the magnet into optimum proximity to the rail 113. Therefore, in this default mode, the braking system operates in response to the inertial forces acting upon the carriage as the carriage traverses the curved portion of the track, such that the maximum braking force is applied to the carriage 101, resulting in the maximum speed penalty.

If the occupant of the carriage partly counteracts the inertial forces, as shown in three perspectives in FIG. 7(*ii*) (a)-(c) in respect of the pitch movement of the handlebar 33, a lesser amount of pitch (shown in this example as approximately 20 degrees) is applied to the handlebar 33. The controller 151 detects that lesser amount of pitch, and causes the actuator 111*c* to move the magnet to an intermediate position relative to the rail 113. The movement by the occupant of the handlebar 33 relative to the chassis 3 to counteract the inertial forces, has moved the magnet 111 away from the rail 113 to reduce the braking force acting on the carriage 101. An intermediate braking force is applied to the carriage, resulting in a lesser speed penalty.

If the occupant of the carriage optimally moves the handlebar 33 to fully counteract the inertial forces, that tilts the handlebar 33 in the opposite direction to the inertial pitch direction, as shown in three perspectives in FIG. 7(*i*) (a)-(c). The controller 151 detects that optimal pitch, and causes the actuator 111*c* to move the magnet 111 to a fully raised position relative to the conductive rail 113. The additional movement by the occupant of the carrier 105 relative to the chassis 3, has caused the controller 151 to further move the magnet 111 away from the rail 113 to further reduce or avoid the braking force acting on the carriage. That results in minimal or no speed penalty.

The handlebar may additionally, or alternatively, tilt forward from the neutral position of FIG. 7(*iii*) as the carriage traverses a curved portion of the track of opposite direction.

Additionally, or alternatively, the carrier 5 may be configured to pivot relative to the chassis 3 about a lateral pitch axis, and the carriage may be configured to enable the occupant(s) to shift their body weight forward on the carrier when cresting a hill portion of the track, or rearward on the carrier exiting a dip portion of the track, to tilt the carrier 5 relative to the chassis 3 to counteract inertial force-induced movement of the carrier 5, to minimise or avoid the braking force being applied to the carriage. In such embodiments, the carriage may be configured so that the lateral pitch axis is proximate to the centre of mass (CoM) of the occupant(s). In one configuration, the carrier 5 and the handlebar 33 may be separately pivotable around respective pitch axes. Each of the carrier 5 and handlebar 33 may be provided with respective pitch sensors 155. The occupant may be required to move the carrier 5 and the handlebar 33 to counteract the inertial force-induced movement of the carrier and handlebar, to maintain an optimal speed through the curved portion of the track.

In an embodiment with both pitch and roll steering, the chassis 3 and the handlebar section 33 and/or carrier 5 may be articulated so that the front portion (e.g. the handlebar section) is configured to pitch in the absence of a counteraction by an occupant to counteract inertial forces as the carrier traverses a curved portion of the track, and the rear portion (the carrier) is configured to roll in the absence of a counteraction by an occupant as the carrier traverses a curved portion of the track. The handlebar 33 could still be pushed against by the occupant to counteract the roll of part of the carrier 5 relative to the chassis 3 because the roll axis RA of the carrier 5 and the handlebar pitch axis 35 are perpendicular.

In an embodiment, the carriage may comprise sway steering. For example, with reference to FIGS. 8(*i*)-8(*iii*), 14, and 15, the carrier 5 may be slidable relative to the chassis 3 along a lateral axis 35. The occupant(s) may brace against the handlebar 33 (not shown), which may be fixed relative to the chassis 3, to shift their weight sideways on a slidable frame 6 to move the carrier 5 to counteract the inertial force-induced sway movement of the carrier 5 relative to the chassis. The slidable frame may comprise an upper frame portion 6*a* that is fixed relative to the carrier 5, and a lower frame portion 6*b* that is fixed relative to the chassis. The upper frame portion 6*a* and lower frame portion 6*b* can be slidably coupled to each other in any suitable manner, for example by using glides or bearings, and respective slide members. Stops will be provided to limit the lateral movement of the upper frame portion 6*a* relative to the lower frame portion 6*b*. The carrier 5 is preferably biased by one or more biasing members (not shown) to a neutral position relative to the chassis 3.

Figure 8I:
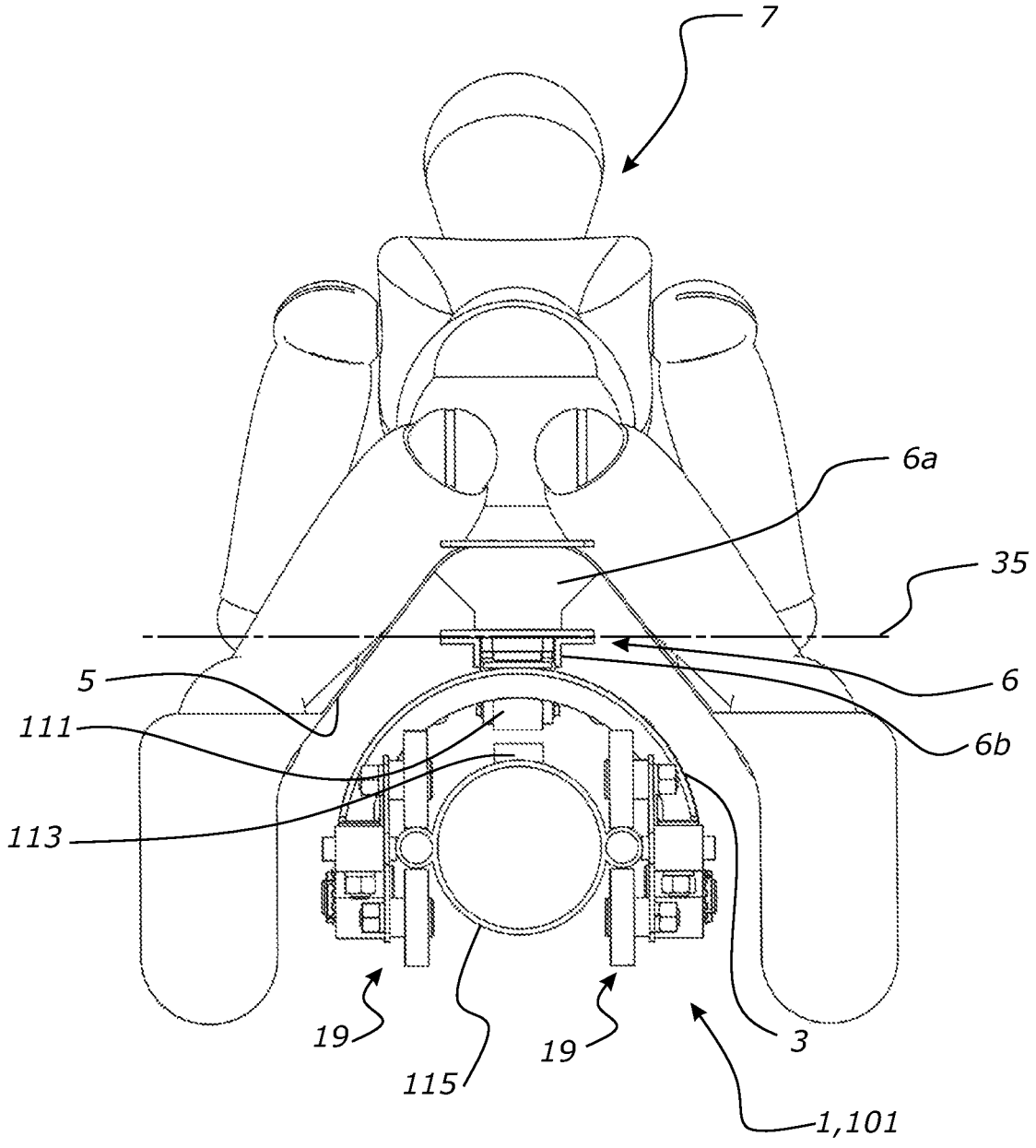
FIGS. 8(*i*) to 8(*iii*) are rear elevation views of a carriage of an exemplary embodiment of the invention with a sway steering feature, where FIG. 8(*i*) shows the carrier of the carriage in a neutral position, FIG. 8(*ii*) shows the carrier of the carriage in an intermediate offset position in which inertial forces have been partly counteracted by an occupant, and FIG. 8(*iii*) show the carrier of the carriage in a fully offset position in which the inertial forces have not been counteracted by an occupant.
Figure 8:
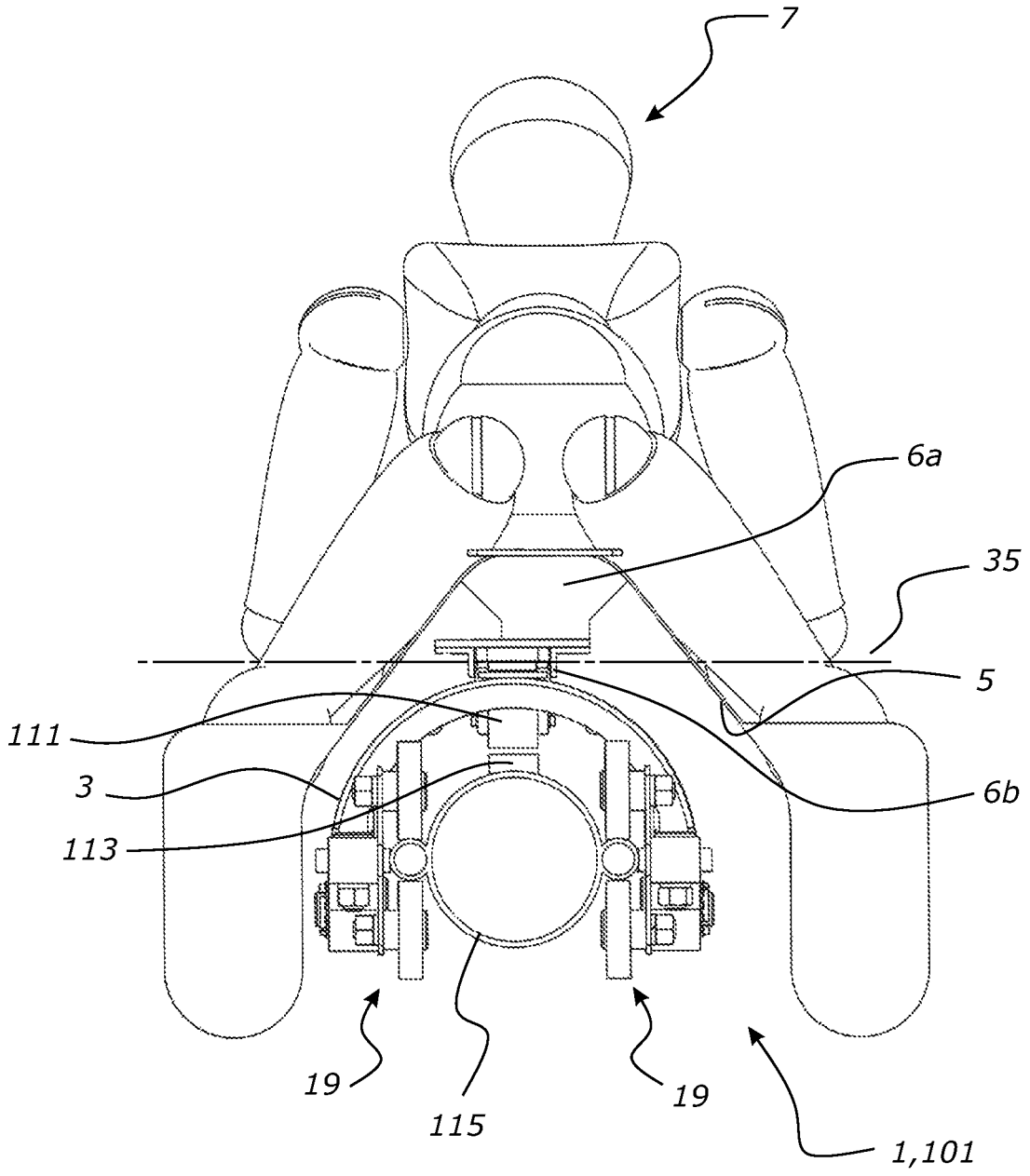

FIG. 8(*i*) indicates the carrier 5 in a neutral position, where it substantially centred over the chassis 3. The permanent magnet 103 is not proximate to the conducting element 113 on track 115 with the result that no eddy current braking force is created. FIG. 8(*iii*) shows the carriage negotiating a left turn in the track 15 wherein the inertial force, in this case centrifugal force, has caused the carrier 5 to slide to the right relative to the chassis 3, to the maximum permissible extent. The occupant has not counteracted the inertial-force induced movement. The inertial force-induced movement is detected by sway sensor 158 (not shown in FIG. 8). The controller 151 causes the actuator 111*c* to move the permanent magnet 103 into proximity with the conducting element 113. The permanent magnet 103 is then optimally distant from conducting element 113 thereby creating the maximum eddy current braking force.

FIG. 8(*ii*) shows the carrier 5 in an intermediate offset position relative to the chassis 3 as the occupant has partly counteracted the centrifugal force acting on the carriage by sliding the carrier 5 back to the left relative to the chassis 3. The controller 151 will cause the permanent magnet 103 to move to an intermediate permission in relation to conducting element 113 thereby reducing the eddy current braking force acting on the carriage.

Alternatively, or additionally, the handlebar section 33 may be configured to roll around the longitudinal axis RA and the carrier 5 may be configured to slide along the longitudinal axis in order to create a backward and forwards movement to provide the opportunity for surge steering.

Alternatively, or additionally, the carriage 1 may comprise yaw steering. For example, the handlebar 33 may be rotatable about a vertical axis that is perpendicular to the longitudinal axes of the chassis 3 and track 15. The occupant(s) could move the handlebar 33 about the vertical axis in response to twists in the track 15 to counteract the inertial yaw force that acts on the handlebar as the carriage travels through twisted portions of the track, to reduce or substantially avoid the braking of the carriage. In an alternative form, the forward part of the carrier including the handlebar 33 may be fixed relative to the chassis, and the main, rear part of the carrier 5 that supports the occupant may be rotatable about a vertical pivot axis that is perpendicular to the longitudinal axes of the chassis 3 and the track 15. The occupant(s) could apply force to the handlebar 33, to pivot the rear part of the carrier about the vertical axis in response to twists in the track 15 to counteract the inertial yaw force that acts on the handlebar as the carriage travels through twisted portions of the track, to reduce or substantially avoid the braking of the carriage.

Alternatively, or additionally, the carriage 1 may comprise heave steering. For example, the handlebar 33 may be slidable along the vertical axis. The occupant(s) could move the handlebar 33 along the vertical axis in response to upwards or downwards bends in the track 15 to counteract the inertial heave force that acts on the handlebar as the carriage travels through the upwards or downwards bends in the track, to reduce or substantially avoid the braking of the carriage. In an alternative form, the forward part of the carrier including the handlebar 33 may be fixed relative to the chassis, and the main, rear part of the carrier 5 that supports the occupant may be slidable along the vertical axis. The occupant(s) could apply force to the handlebar 33, to slide the rear part of the carrier along the vertical axis to counteract the inertial heave force that acts on the rear part of the carrier as the carriage travels through the upwards or downwards bends in the track, to reduce or substantially avoid the braking of the carriage. The main, rear part of the carrier, may be biased to reduce the amount of physical force that an occupant needs to apply to vertically move the rear part of the carrier.

Figure 9:
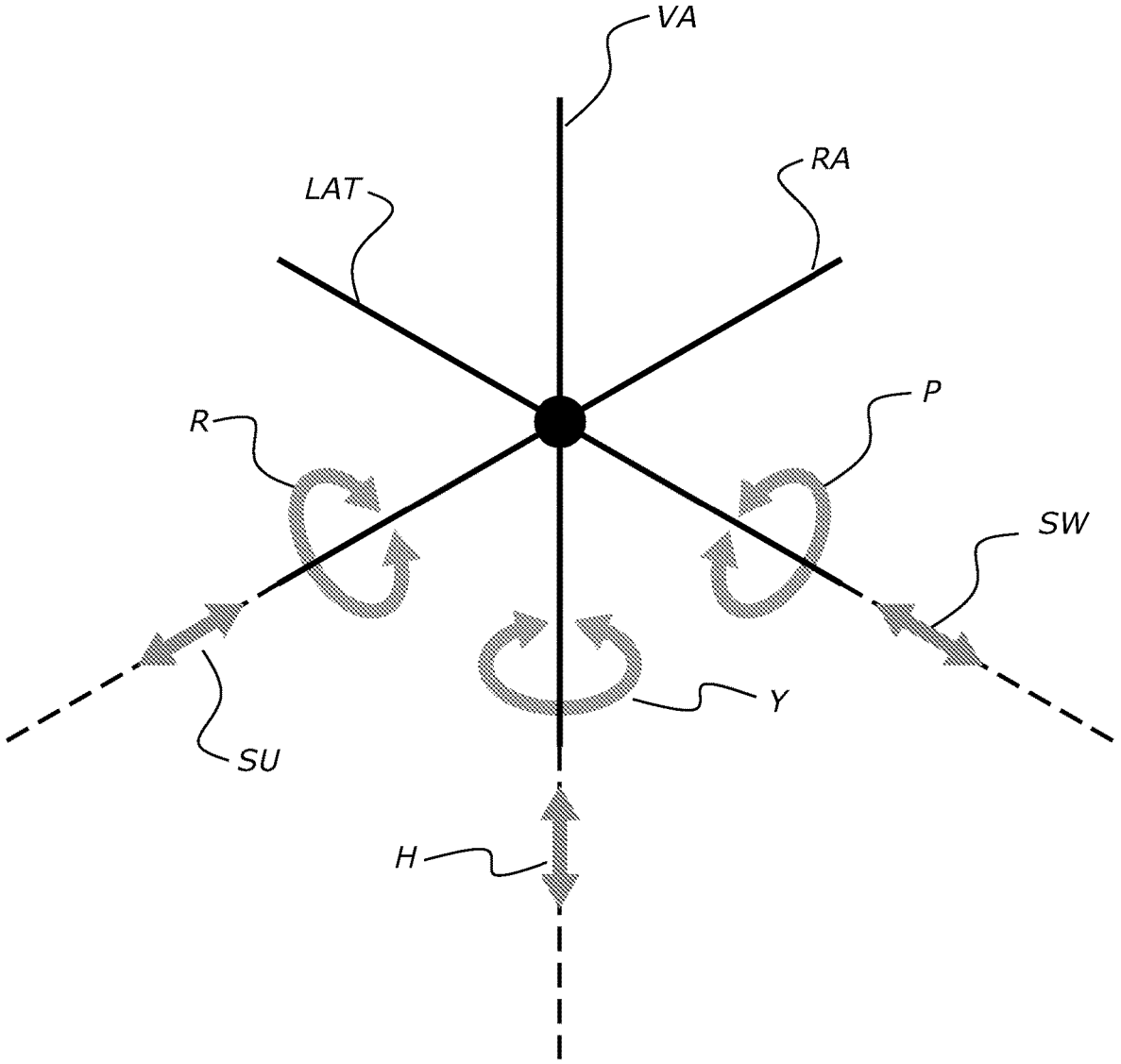
FIG. 9 is a view showing possible inertial-force induced movements for at least parts of carriages of exemplary embodiments of the invention.

With reference to FIG. 9, it will be appreciated by those skilled in the art that the rotational movements and the translational movements of the at least part of the carriage each relate to three perpendicular axes (the longitudinal axis RA, lateral axis LAT, and vertical axis VA). Roll R, pitch P, and yaw Y movements (which involve a pivotable movement about each relevant axis) may alternatively, or additionally, be surge SU, sway SW, and heave H movements (which involve a slidable movement along each relevant axis). The occupant(s) may move at least part of the carriage, such as the carrier for example, along the axes by moving their bodyweight to counteract the inertial surge SU, sway SW, or heave H forces acting on the carrier 5. Alternatively, or additionally, the carriage may be configured to enable the occupant(s) to move at least part of the carriage in response to the inertial forces acting on the carriage. For example, the handlebars 33 of FIG. 7 may be rotated forward and backward about the lateral axis in response to the pitch motion of the at least part of the carriage, or they may be slidably moved sideways along the lateral axis in response to the sway motion of the at least part of the carriage.

Similarly, the carrier 5 of FIG. 1 may be rotated sideways about the longitudinal axis RA in response to the roll motion R of the at least part of the carriage or it may be slidably moved forward and backward along the longitudinal axis LA in response to the surge motion SU of the at least part of the carriage.

In an embodiment, the carriage may be configured to define a vertical yaw axis V about which at least part of the carriage might pivot in response to inertial forces acting on the carriage. In such embodiment the carriage may be configured alternatively, or additionally, to define a vertical heave axis VA along which at least part of the carriage might slide in response to inertial forces acting on the carriage.

It will be appreciated from FIG. 9, that any suitable part or parts of the carriage may be configured to roll and/or pitch and/or yaw (rotational or pivoting movements) and/or to surge and/or sway and/or heave (translational movements), in response to non-counteracted inertial forces as the carriage traverses curved portion(s) of the track. FIG. 9 shows the movements that may be applied to the part of the carriage, such as heave H along a vertical axis VA, yaw Y about the vertical axis VA, surge SU along a longitudinal axis RA, roll R about the longitudinal axis RA, sway SW along a lateral axis LAT, and/or pitch P about the lateral axis LAT. The movements could be provided in any suitable combination, in one or more parts of the carriage. The carriage may be provided with a suitable number of orthogonally-oriented pivots to provide the rotation or pivot axes and/or may be provided with a suitable number of orthogonally-oriented slide arrangements to provide the translational axes. The carriage will be provided with suitable means to enable the occupant to counteract the inertial force-induced movements of the part(s) of the carriage (such as by moving their bodyweight, applying a physical force, and/or using a user interface that, via one or more actuators, will cause movement of the part(s) of the carriage), to counteract the induction of the braking force, to reduce or avoid the corresponding braking effect on the carriage.

Figure 15:
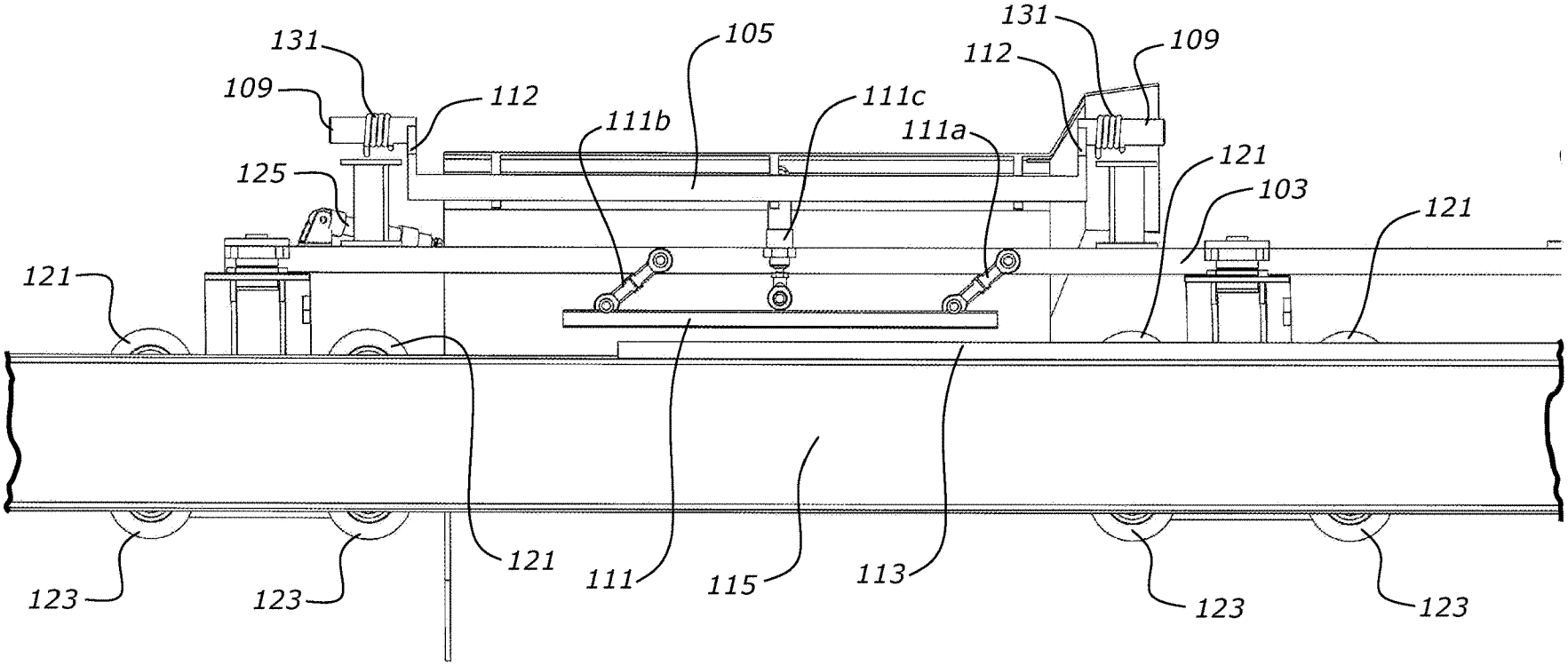
FIG. 15 is a side partial sectional view of the carriage of FIGS. 14(*i*) to 14(*iii*), showing the brake in a raised position relative to the carrier and track.

In an embodiment, one or more of the roll, pitch, yaw, surge, sway or heave steering features of the ride may comprise a single magnet 111, or array of magnets, as illustrated at FIG. 15. In an embodiment, at least one sensor may sense at least one of the movements of the least part of the carriage and, by means of the electrical controller 151 and actuator(s) 111*c*, engage (or disengage as the case may be) the single magnet or array of magnets.

The racing amusement ride preferably comprises at least two tracks 15 of the same length and curvature side-by-side, with a carriage on each track. With this arrangement, two occupants can race each other, and the occupant that tilts the carrier 3 better through the corners and/or tilts the handlebars 33 better through rises or dips in the track 15, travels the length of the track 15 the fastest. Alternatively the ride may be a time-trial style ride with only one track and one or more carriages 1 that travel along the track 15.

The amusement ride may comprise augmented reality or virtual reality systems to enhance the occupant experience. For example the occupant may wear a headset or glasses, or the carriage may comprise a wind-screen with a heads-up display system, or a wrap around screen to provide an augmented reality or virtual reality experience.

Example Calculations—Bank Angle

System forces were calculated for an exemplary embodiment carriage 1, occupant and a right-hand track bend have the following parameters:

| Parameter | Value | Unit |
|---|---|---|
| Occupant mass | 70 | kg |
| Carriage mass | 150 | kg |
| Total system mass | 220 | kg |
| Carriage velocity | 15 | m/s |
| Curve radius | 10 | m |
| Gravitational acceleration | 9.81 | $m/s^2$ |
| Weight force (system) (SWF) | 2158 | N |
| θ, ideal (bank angle) | 66 | ° |
| θ, actual (bank angle) | 54 | ° |

In this embodiment, the occupant's centre of mass (CoM) is above the carrier roll axis RA by a distance Y2, and the velocity is assumed constant throughout the bend. For this case, the ideal bank angle θ was calculated as described above as 66 degrees. The bank angle for the track bend for this embodiment was selected as 12 degrees less than the ideal bank angle.

Figure 6:
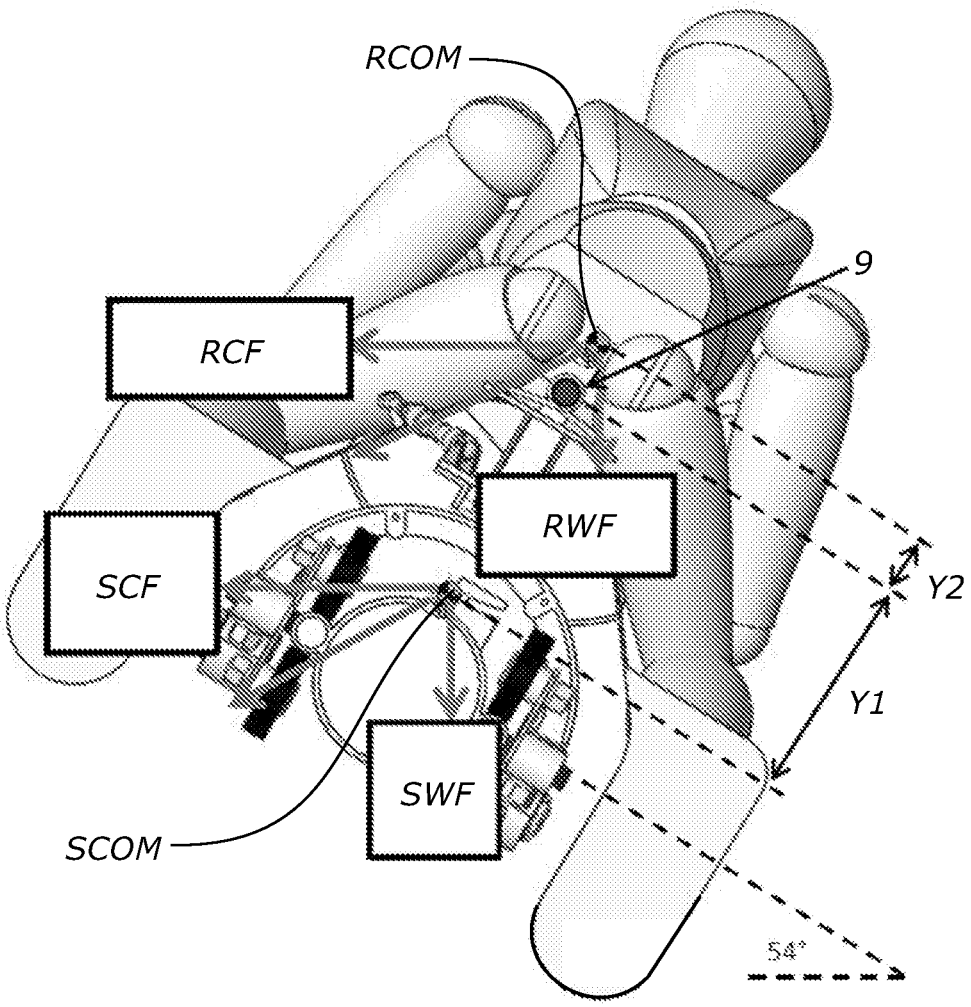
FIG. 6 is the view of FIG. 5, but showing reaction forces acting on the occupant and carrier.

The occupant weight and centrifugal force pivot moments can be obtained from dimension Y2 (FIG. 6). This is the torque that is developed about the pivot axis RA of the carrier 5 due to the occupant mass and centrifugal force respectively. These moments act in opposing directions—the centrifugal moment acts to rotate the occupant in the anti-clockwise direction while the weight moment acts to rotate the occupant clockwise. These moments and other key values are highlighted in the table below.

| Parameter | Value | Unit |
|---|---|---|
| Centrifugal force (occupant) (RCF) | 1575 | N |
| Centripetal force (system) (SCF) | 4950 | N |
| Pivot centre - vehicle CoM (Y1) | 0.4 | m |
| Pivot centre - occupant CoM (Y2) | 0.2 | m |
| Weight pivot moment | 112 | Nm |
| Centrifugal pivot moment | 183 | Nm |
| Resultant moment | 72 | Nm |
| Moment with 0.1 m shift | 3 | Nm |

The resultant moment (centrifugal minus weight) is 72 Nm and acts anti-clockwise. This is equivalent to a 37 kg mass acting at a distance of 0.2 m, so the effect is considerable. In combination with the torsion spring 31 and dampers 25, this will provide controlled tilting of the occupant to the left in the right-hand bend.

For example, an average occupant may shift their centre of mass CoM a horizontal distance of 0.1 m by sliding in the carrier 5 and moving their torso to their right. This increases the clockwise moment due to occupant weight to 180 Nm and provides a final resultant moment of 3 Nm. The 70 kg occupant would need to initially push against an equivalent force of approximately 363 N to start to realign their position with the line of the vehicle. The force requirement would gradually decrease as they reverted to the neutral position. This would mimic the motorbike style of shifting weight where less shifting would need to be done as they returned to the neutral position. In reality the occupant would be able to see the bend approaching ahead of them and would adjust their body position accordingly before entering the turn to stay central for the duration of the curve.

As a comparison to the 70 kg occupant, the calculations were carried out for a 100 kg occupant for the same carriage velocity and curve radius:

| Parameter | Value | Unit |
|---|---|---|
| Centrifugal force (occupant) | 2250 | N |
| Pivot centre - vehicle CoM, (Y1) | 0.4 | m |
| Pivot centre - occupant CoM, (Y2) | 0.2 | m |
| Weight pivot moment | 160 | Nm |
| Centrifugal pivot moment | 262 | Nm |
| Resultant moment | 102 | Nm |
| Moment with 0.1 m shift | 4 | Nm |

This illustrates that for a 10 m radius curve and the vehicle travelling at 15 $ms^{-1}$ (54 $kmh^{-1}$), under banking the curve by 12° allows for a similar dynamic response between occupants of different masses when the occupant shifts their body weight to offset the tilt.

A heavier occupant will need to push against a force of 510 N to roll the carrier 5, compared to 363 N for a 70 kg occupant. However, a heavier person is often stronger, so this scaling of force required as size increases is a suitable outcome. The shifting of body position would have a negligible impact on the speed of the carriage 1 in the absence of the magnetic brake system, but will be a critical to avoiding engaging the eddy current brakes.

In some embodiments, it may be desirable for the carrier 5 to be adjustable to adjust the height Y2 of the centre of mass of the occupant above the pivot axis 9.

The above calculations are for exemplary cases only. Similar calculations would need to be carried out on a case by case basis for each track curve and specific carriage design. There is no single under bank angle value that would be suitable for every curve. The degree of under-banking required will depend on the track curve radius and entry speed of the carriage into the bend such that each curve on the track would need to be analysed individually.

Example Calculations—Brake Force

Figure 10:
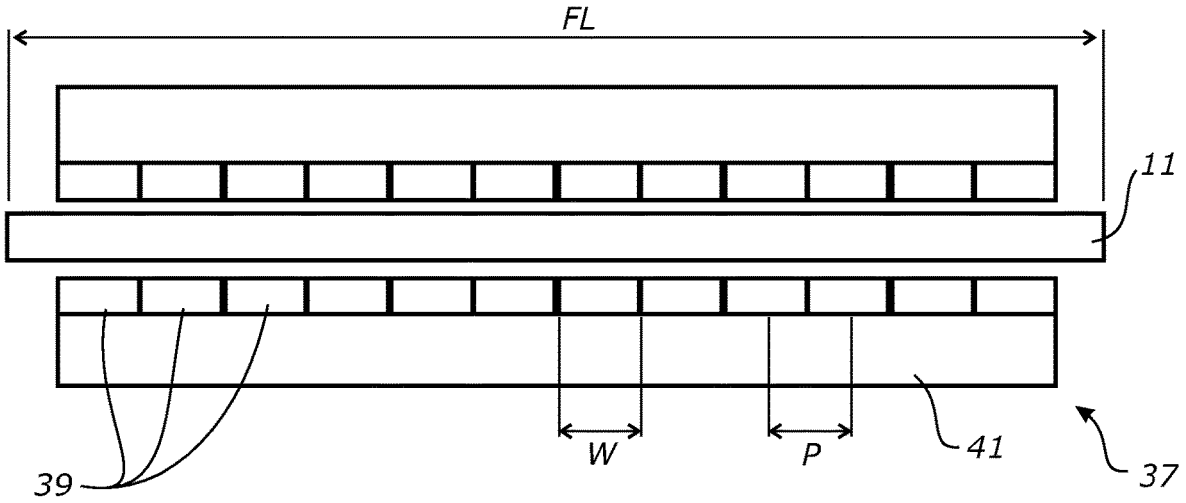
FIG. 10 is a schematic plan view of a fin in an exemplary magnetic array on the track.

FIGS. 10 and 11 show an exemplary embodiment eddy current brake system 37. The system comprises an array of twelve 40MGOe Neodymium-Iron-Boron (NdFeB or more commonly, neodymium) magnetic elements 39 and an aluminium conducting fin 11. The magnetic elements 39 are enclosed by ferromagnetic (iron) yoke 41 to enhance the magnetic field strength. The magnitude of the braking force depends on the strength of magnetic field, the size/mass of the conductor, the conductivity of fin material, and the velocity of conductor.

The exemplary embodiment eddy current brake system 37 in FIGS. 10 and 11 has the following parameters:

| Parameter | Value | Unit |
|---|---|---|
| Magnet energy product | 40 | MGOe |
| Pole pitch (P) | 260 | mm |
| Magnet width (W) | 250 | mm |
| Magnet thickness (MT) | 10 | mm |
| Fin thickness (FT) | 5 | mm |
| Air gap (AG) | 3.5 | mm |
| Fin conductivity | $34 \times 10^6$ | S/m |
| Fin-magnet penetration (FP) | 40 | mm |
| Iron yoke thickness (YT) | 20 | mm |

Figure 12:
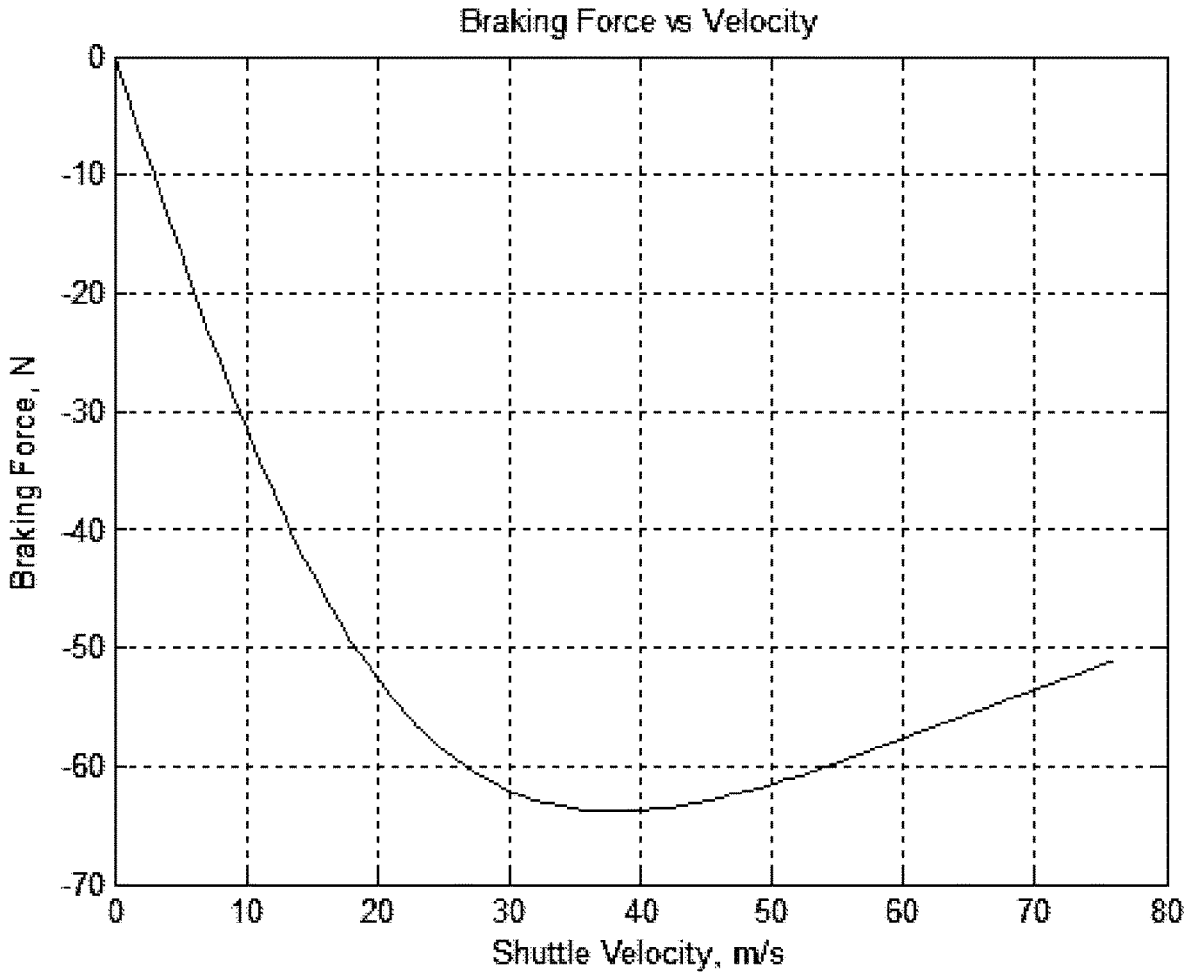
FIG. 12 is a graph showing the braking force acting on the carriage for an exemplary embodiment magnetic braking arrangement.
Figure 13:
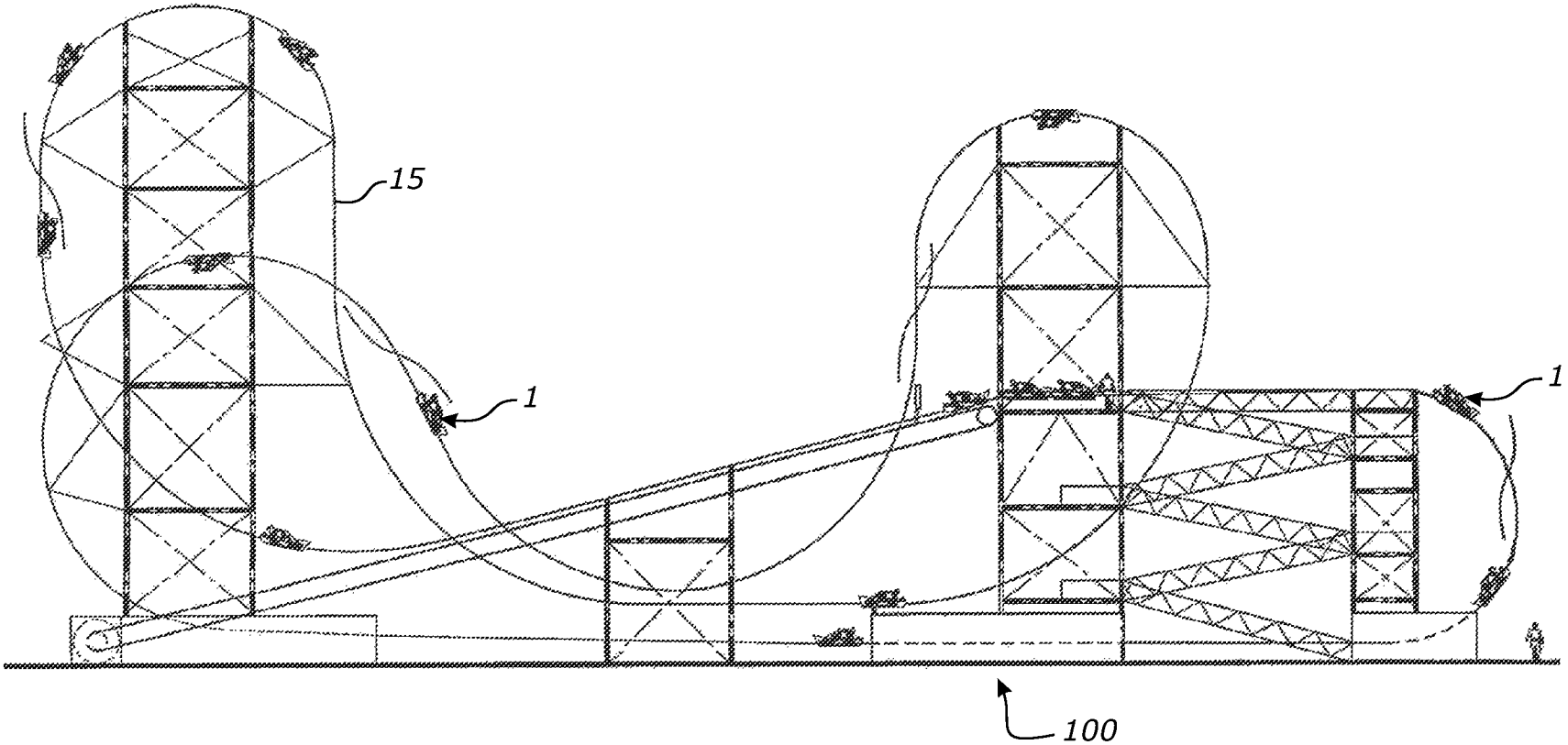
FIG. 13 is a schematic side view an exemplary embodiment amusement ride.

FIG. 12 shows a graph of the braking force provided by this arrangement for different carriage (fin) velocities. The graph assumes that the fin 11 fully penetrates the depth of the gap between the magnet arrays (i.e. the occupant is tilted in the saddle in the furthest possible position and experiences maximum braking), and the air gap either side of the fin remains constant during the curve. These calculations also assume the magnets 39 and fin 11 are rectangular, for simplicity and that the conductivity of the aluminium fin 11 is constant over its entire length. In practice the magnets 39 and fin 11 are likely to be curved, however, these simplified calculations still provide a good approximation to the magnitude of the braking effect for a curved arrangement.

The graph shows that from 0 $ms^{-1}$ to 20 $ms^{-1}$, the braking force is proportional to the carriage 1 velocity. Up to approximately 30 $ms^{-1}$ the braking force increases with increasing velocity. Beyond that point saturation occurs where the conducting fin has generated a maximum level of eddy current and no further braking force can be achieved even with an increase in velocity. The brake force will taper off beyond this saturation point.

The brake force will also ramp up in proportion to how much of the length FL of the fin 11 is exposed to the magnetic array 37. When the fin 11 just begins to engage with the magnetic field the brake force will be proportionately low. The brake force will continually increase until it reaches a maximum value once the full length of the fin 11 and magnetic array 37 are overlapping each other. This effect is distinct from the penetration depth FP of the fin 11 within the magnetic array 37, which is dependent on how accurately the carrier 5 is tilted. However, both effects increase the brake force dependent on proximity, but in different planes.

For the above example with a carriage velocity of 15 $ms^{-1}$ and a 10 m radius curve, the carriage would experience a braking force of about 325 N. That is equivalent to 33 kg of force which is not significant for a system with a total mass of 220 kg and translates to a drop in velocity of about 0.5 $ms^{-1}$ around the curve due to the influence of the eddy current brake.

In a system where the length of the track 15 has a total of 100 m of curved sections, a perfectly tilted carriage 1 with the above parameters will navigate through them in 6.67 s. In contrast, an un-tilted carriage 1 experiencing the maximum braking force through all of the bends with the same system mass would complete it in 6.9 s. This will provide a 0.23 s time discrepancy from the perfectly steered vehicle. Assuming the slowed vehicle with no tilt correction completed the straight portions of track at the same speed as the perfectly tilted vehicle, the separation distance purely due to braking on the curves would be 3.33 m. In reality a carriage 1 with no tilt correction would be slower on straight track sections too, having lost speed around the corners.

A larger separation distance between correctly tilted carriages and untilted carriages is desirable to increase the competitive aspect of the amusement ride. Greater separation distances can be achieved by increasing the size or number of the individual magnets 39, replacing the aluminium fin 11 with a higher conductivity metal, and adjusting the air gap AG to fine tune the system characteristics.

Calculations for a system with pitch steering can readily be carried out as described above. There would be a suitable number of rises and dips along the length of the track 15 for the braking to have a meaningful impact on ride times and make the inclusion of such a system worthwhile.

The exemplary embodiment system uses permanent magnets on the track bends. Neodymium, a rare-earth type magnet is the strongest permanent magnetic commercially available and is relatively easy to source. However, alternatively the magnets could be electro-magnets. Electro-magnets offer the advantage of being able to raise or lower the current to control the strength of the magnetic field. This could be adjusted based on the mass of the occupant to account for discrepancies in ride performance due to occupant mass. The carrier may need to magnetically shield the occupant from the magnets to prevent any detriment to the occupant due to the high magnetic forces.

The fin 11 preferably comprises a high conductivity material to enable stronger eddy currents to be induced and thereby increase the braking force. Suitable materials are well known to those skilled in the art. For example silver is a high conductivity, non-magnetic, but expensive material. Alternatively, aluminium, copper or brass, have high conductivities and are cheaper and easier to source.

Figure 14I:
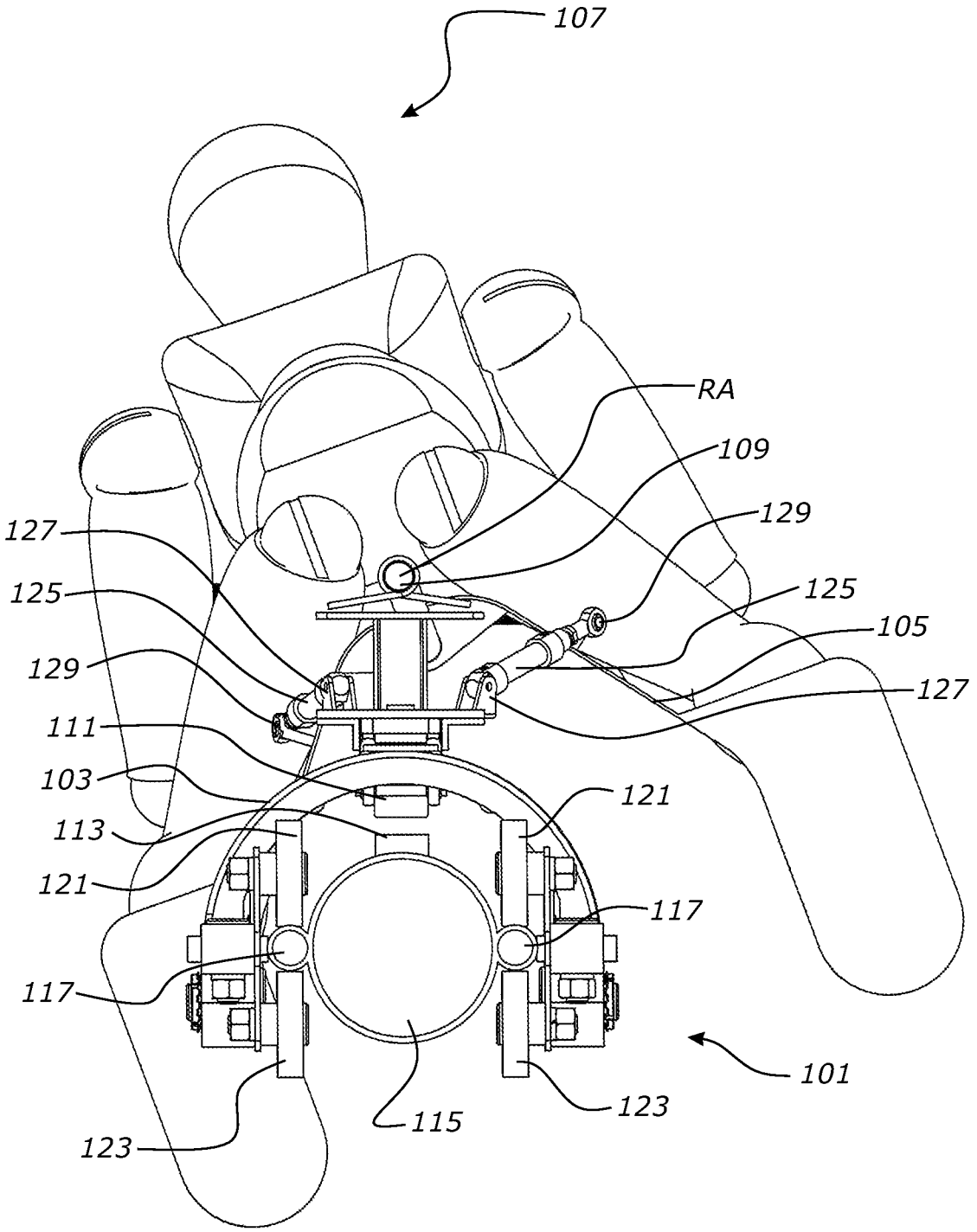
FIG. 14(*i*) is a rear elevation of the carriage of an alternative exemplary embodiment of the invention showing the position of a centrally located permanent magnet, electro-magnet, or friction brake relative to the carriage and the track, with the occupant of the carriage in an optimal leaned position to fully counteract inertial forces while traversing a left hand bend.
Figure 14:
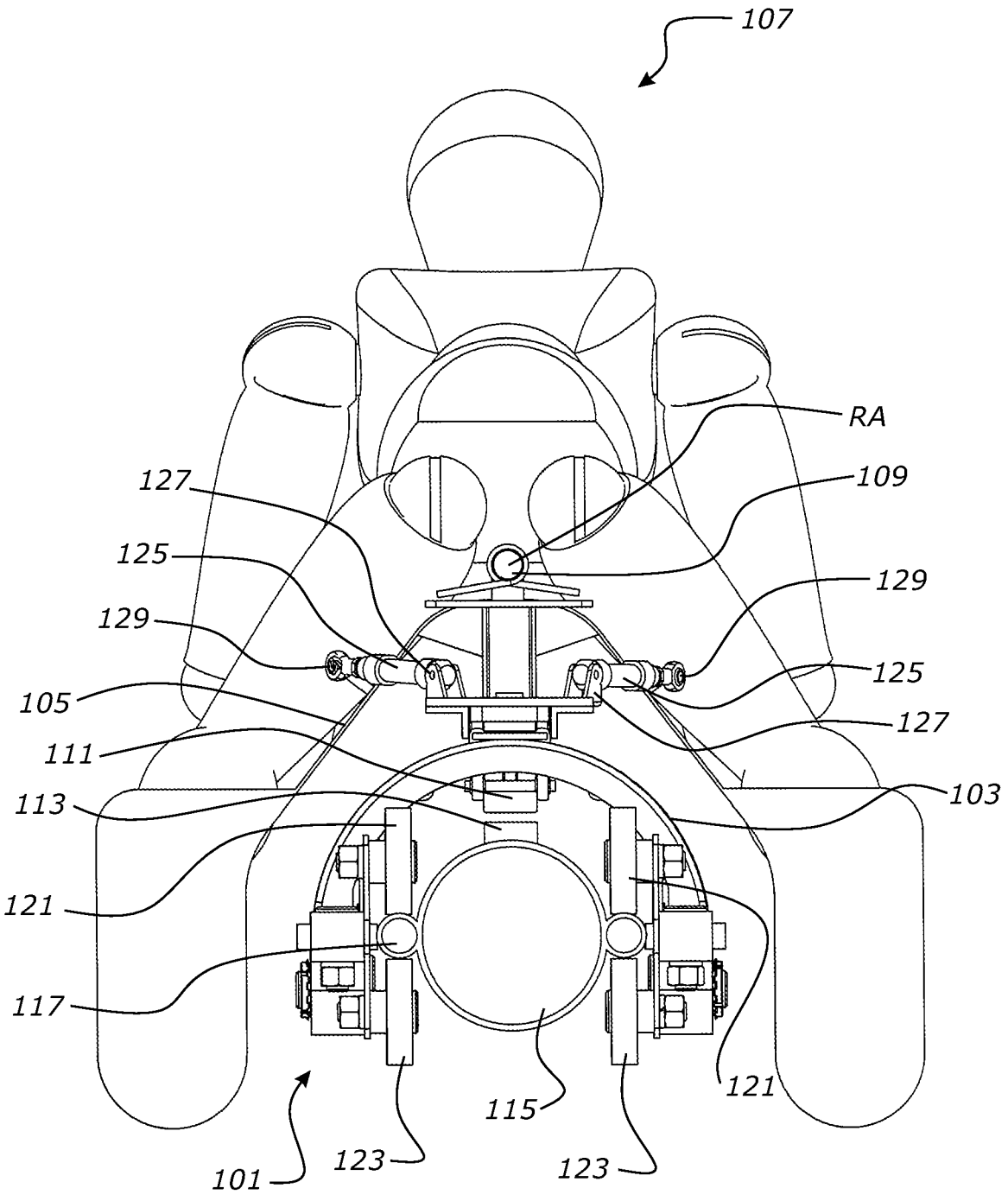

FIGS. 14(*i*) to 14(*iii*) show an alternative exemplary embodiment carrier and track. Unless described below, the features, functionality, and alternatives should be considered the same as for the embodiment described above, and like reference numerals indicated like parts with the addition of 100.

In this embodiment, the magnetic braking system may comprise a permanent magnet 111 on the carriage 101 that acts on a conductive component in the form of a rail 113 on the track 115. Alternatively, the magnetic braking system may comprise an electro-magnet 111 on the carriage 101 that acts on a conductive component or rail 113 on the track 115. In yet another alternative, the braking system may comprise a friction braking pad 111 on the carriage 101 that acts on a braking rail 113 on the track 115. Alternatively, the configuration may be reversed so that the permanent magnet, electro-magnet, or friction braking pad may be provided on the track, and the conductive component or braking surface may be provided on the carriage. In such a configuration the controller 151 described below may be connected wirelessly to control the permanent magnet, electro-magnet, or friction braking pad. The conductive component may, for example, comprise any suitable conductive metal element. For example, the conductive component may comprise copper capping that is provided at selected sections of the track.

In the form shown, the braking system comprises a permanent magnet assembly 111 movably supported from the carriage chassis 103. In the form shown, the permanent magnet 111 comprises a magnetic component that is elongate in a forward-rearward direction of the carriage, and is centrally located under the carriage chassis 103. Forward and rearward pivoted links 111*a*, 111*b* are pivoted to the chassis 103 and the magnet assembly 111, to form a four bar linkage which enables the height of the magnet 111 to be adjusted relative to the chassis 103 and the conductive rail 113 on the track. An actuator 111*c*, which in the form shown is a hydraulic actuator but alternatively could be an electrical actuator, is extendible and retractable to change the height of the magnet 111 relative to the conductive rail 113, and thereby the extent of the magnetic braking applied between the carriage and the track. The actuator 111*c* will be controlled by an electrical controller 151. The controller could be any suitable type of controller such as a hardware controller or a computer processor for example.

The magnet 111 is controlled by the controller 151 so that in a default mode (shown in FIG. 14(*iii*)) in response to at least one inertial force acting on the carriage that causes movement of at least part of the carriage (e.g. the carrier 105 relative to the chassis 103), the magnet 111 moves into proximity with the conductive rail 113 so as to cause an eddy current braking force on the carriage 101. In the position of FIG. 14(*iii*), the inertial forces as the carriage traverses the corner have not been counteracted by the occupant, which means that the carrier 105 is at a maximum tilt angle relative to the chassis 103 about axis RA.

Figure 16:
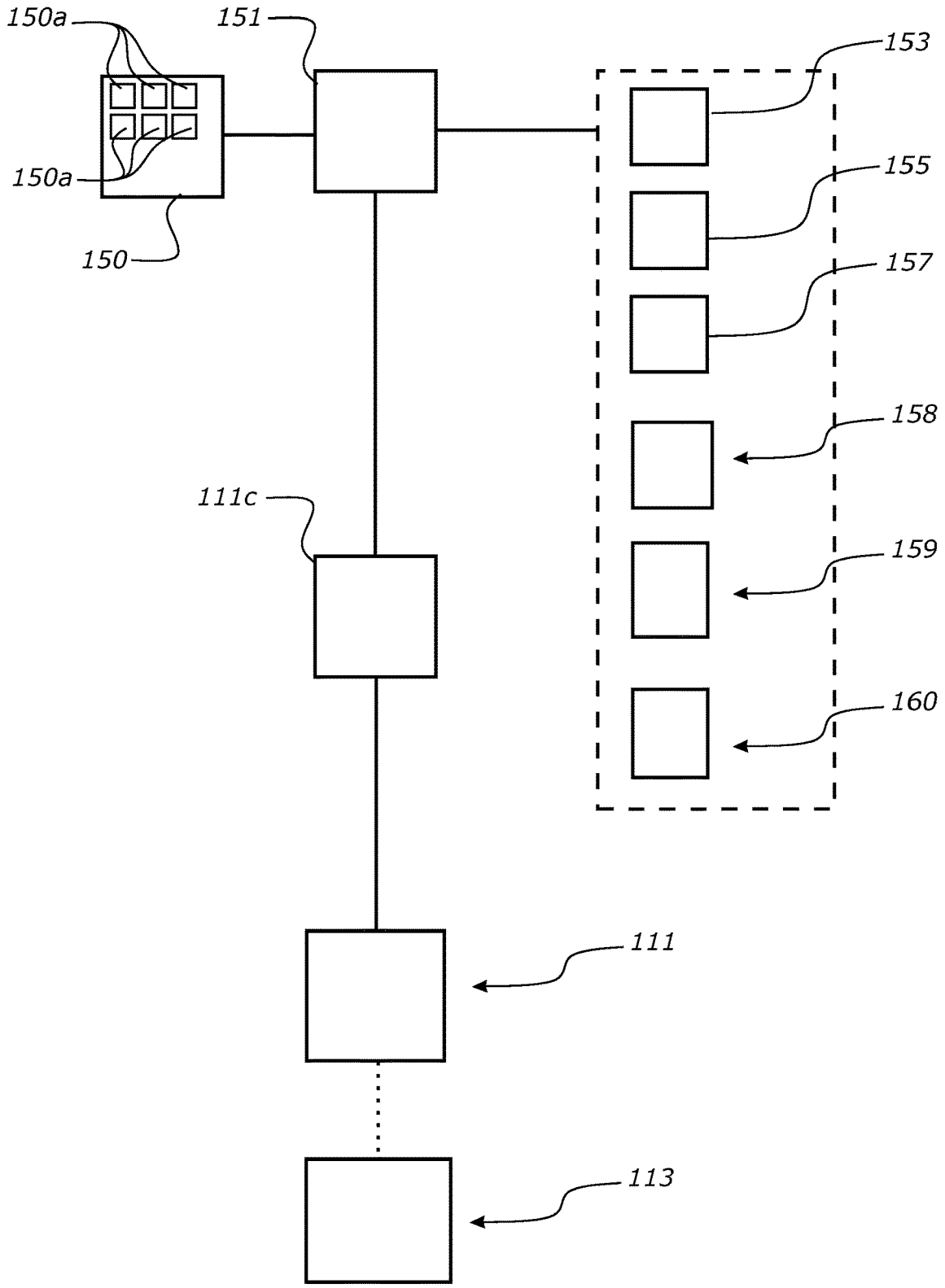
FIG. 16 is a schematic view of a sensor and controller layout of an exemplary embodiment of the invention.

The movement of the at least part of the carriage (e.g. the carrier, handlebar, and/or other suitable part of the carriage) in response to the inertial force may be detected by a suitable sensor(s). For example, as shown in FIG. 16, the carriage 101 may be provided with one or more of a roll sensor 153, pitch sensor 155, or yaw sensor 157 mounted on the carrier 105, which are connected to the controller 151. The carriage may also, or alternatively, be provided with one or more of a sway sensor, surge sensor or heave sensor (not shown) also connected to the controller 151. The controller 151 is connected to the braking system actuator 111*c*. The sensor(s) will indicate when inertial force-induced movements are applied to the at least part of the carriage, and the magnitude of those forces. In response to the indication of forces, the sensors will cause the actuator 111*c* to move the magnet 111 into proximity with the conductive rail 113. The extent of that movement will depend on the magnitude of the inertial force-induced movement. For example, in the position shown in FIG. 14(*iii*), the occupant has not counteracted the inertial forces applied to the carrier 105. Therefore, the roll applied to the carrier 105 is a maximum. The controller 151 detects that maximum roll, and causes the actuator 111*c* to move the magnet 111 downwards a maximum distance, bringing the magnet into optimum proximity to the rail 113, for example 5 mm distance from the rail. Therefore, in this default mode, the braking system operates in response to the inertial forces acting upon the carriage as the carriage traverses the curved portion of the track, such that the maximum braking force is applied to the carriage 101, resulting in the maximum speed penalty.

If the occupant of the carriage partly counteracts the inertial forces, as shown in FIG. 14(*ii*), a lesser amount of roll or no roll is applied to the carrier 105. The controller 151 detects that lesser amount of roll, and causes the actuator 111*c* to move the magnet to an intermediate position relative to the rail 113. The movement by the occupant of the carrier 105 relative to the chassis 103 to counteract the inertial forces, has moved the magnet 111 away from the rail 113 to reduce the braking force acting on the carriage 101. An intermediate braking force is applied to the carriage, resulting in a lesser speed penalty.

If the occupant of the carriage optimally shifts their weight to fully counteract the inertial forces, that tilts the carrier 105 in the opposite direction to the inertial roll direction, as shown in FIG. 14(*i*). The controller 151 detects that optimal roll, and causes the actuator 111*c* to move the magnet 111 to a fully raised position relative to the conductive rail 113. The additional movement by the occupant of the carrier 105 relative to the chassis 103, has further moved the magnet 111 away from the rail 113 to further reduce or avoid the braking force acting on the carriage. That results in minimal or no speed penalty.

The controller 151, based on a determined extent of a non-counteracted inertial force applied to the carriage 101, moves the magnet 111 to a corresponding position relative to the conductive rail 113, thereby providing a corresponding extent of braking of the carriage on the track. Upon an action of an occupant of the carriage to counteract the inertial force-induced movement, the magnet 111 is caused to move by the controller 151 so that the magnet 111 is moved proportionately out of proximity of the conducting element to reduce or substantially avoid the braking force acting on the carriage. Therefore, with optimal movement of an occupant's bodyweight to counteract inertial forces, an occupant may traverse the track with minimal or no speed penalty.

The controller 151 may be responsive to any non-counteracted inertial forces on the carriage that cause one, two, or more of rolling, yawing, pitching of part of the carriage, to cause a corresponding braking force between the carriage and the track.

Figure 17:
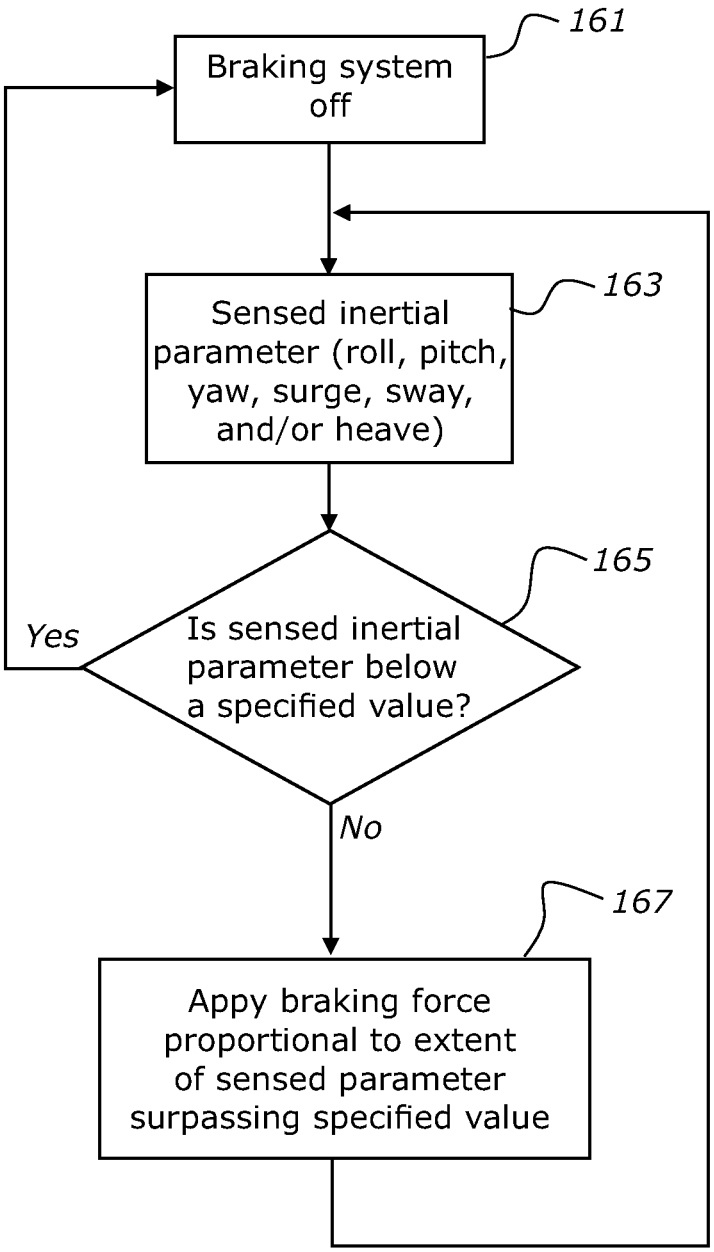
FIG. 17 is a flow chart of an exemplary process performed by the controller of FIG. 16.

FIG. 17 shows a control process that may be undertaken by the controller 151. In an initial state 161 when no inertial force-induced movement is detected by the roll, pitch, yaw, sway, surge, or heave sensors, the braking system is off, and the braking system does not slow the vehicle. The controller 151 will respond to a sensed inertial parameter 163, and will determine 165 whether the sensed inertial parameter is below a specified value. If it is below a specified value, the braking system will remain off. Therefore, if an occupant substantially fully counteracts an inertial force (for example, upon entry into a corner), there will not be a speed penalty. If the controller determines that the sensed inertial parameter is equal to or above the specified value, the controller will cause 167 the actuator 111*a* to move the magnet 111 to apply a braking force between the carriage 101 and the conductive rail 113 on the track 115. The extent of movement of the magnet and thereby the extent of the braking force, will be proportional to the extent the sensed parameter surpasses the specified value. The controller will continue to monitor the sensed parameters, and adjust the positioning of the magnet and thereby the braking force.

In an additional, or alternative, configuration for any of the embodiments described herein, the control system and process shown by FIGS. 16 and 17 may include a device operable by the occupant 7, 107 of the carriage in response to the sensed inertial parameter 163, whereby the occupant(s) may override the brake controller 151 to prevent the actuator 111*a* from moving the magnet 111 and thereby avoiding or substantially reducing the braking force. In an embodiment the speed of the reaction of the occupant(s) to the sensed inertial parameter 163 will determine the extent to which the occupant(s) are able to override the brake controller 151. In this embodiment, rather than an occupant needing to counteract the inertial force-induced movement of the at least part of the carriage to counteract the induction of the braking force, the occupant may use the device to counteract the induction of the braking force.

In this configuration, the action by the occupant 7, 107 to counteract the induction of the braking force, comprises the interacting with a user interface device 150 that is operatively coupled with the braking system. The interaction with the user interface device 150 reduces or substantially avoid the braking force acting on the carriage. The user interface device 150 may be connected to or form part of a controller, operable by the occupant in response to the rotational and/or translational movements of the at least part of the carriage, and configured to enable the occupant to at least partly override the induction of the braking system and thereby reduce or avoid the braking effect on the carriage 1, 101. The controller may be integrated with, or connected to, the braking system controller 151. Such an action may be in addition to or as an alternative to the movement of the at least part of the carriage to counteract the at least one inertial force acting on the carriage and thereby counteract the induction of the braking force. For example, it may be necessary for an occupant to both move the at least part of the carriage (for example, the carrier, handlebar, or any other suitable part of the carriage) to counteract the inertial force-induced movement of that or those parts, as well as interact with the user interface, to obtain optimum speed of the carriage 1, 101 through the curved portions of the track.

The user interface may, for example, comprise one or more buttons or switches 150*a* (either physical or formed on a touchscreen) for an occupant 7, 107 to actuate, wherein actuation of at least one of the buttons or switches causes the braking system to be at least partly overridden or disengaged.

The user interface may comprise a plurality of buttons or switches 150, with each button or switch corresponding to a respective one of the degrees of freedom that will be encountered as the carrier traverses curved portion(s) of the track, and that will cause the braking system to slow the travel of the carriage in the absence of counteraction by an occupant. For example, the user interface may comprise up to six buttons or switches. In such an embodiment, the occupant 7, 107 may need to press the correct button(s) or switch(es) 150 that correspond(s) to inertial force(s) that is/are causing movement of the at least part of the carriage, to at least partly override or disengage the braking system on that curved portion of the track. It will be appreciated that this functionality may add a significant skill aspect to the ride, with a highly skilful occupant traversing the track substantially faster than an unskilled occupant.

In an additional, or alternative, configuration for any of the embodiments described herein, the user interface 150*a* may be suitably connected to a controller and actuator(s), such that pressing the button(s) or switch(es) causes physical movement of the at least part of the carriage, to counteract the inertial force-induced movement of the at least part of the carriage as the carriage traverses the curved portion of the track. For example, the carriage may comprise one or more hydraulic actuators (not shown) between the chassis 3 and carriage 5, which are operable to move the carriage 5 relative to the chassis 3 upon pushing a button of the user interface, to counteract the inertial force-induced movement of the carrier 5. Each button or switch may again correspond to a respective degree of freedom, with correct actuation of that button or switch causing a movement of the at least part of the carriage to counteract the inertial-force induced movement.

In this configuration, the action by the occupant to counteract the induction of the braking force comprises interaction with the user interface 150 that is operably coupled with, or connected to, a controller and actuator(s), wherein the interaction with the user interface 150 causes physical movement of the at least part of the carriage, to counter the inertial force-induced movement of the at least part of the carriage, wherein the interaction with the user interface reduces or substantially avoids the braking force acting on the carriage.

The term 'connected to' in relation to the controller 151, sensors, actuator, and associated components includes all direct or indirect types of communication, including wired and wireless, via a cellular network, via a data bus, or any other computer structure. It is envisaged that they may be intervening elements between the connected integers. Variants such as 'in communication with', 'joined to', and 'attached to' are to be interpreted in a similar manner. Related terms such as 'connecting' and 'in connection with' are to be interpreted in the same manner.

In an alternative configuration of FIGS. 14(*i*) to 14(*iii*), the magnet 111 may be an electro-magnet. Rather than physically moving the electro-magnet, the electro-magnet 111 may be permanently set up in proximity with the conducting element or rail 113. The electro-magnet may be controlled by the controller 151 so that in a default mode in response to at least one inertial force acting on the carriage that causes movement of at least part of the carriage (e.g. the carrier 105 relative to the chassis 103), the electro-magnet receives an electrical current from a power supply (not shown) so as to cause an eddy current braking force on the carriage 101. The amount of current applied to the electro-magnet will depend on the extent of the non-counteracted inertial force-induced movement that is applied to the carriage. The controller 151 will be responsive to inertial force-induced movement to vary the extent of the applied current and therefore the extent of the braking between the carriage 101 and the track 115. Upon an action of an occupant of the carriage to counteract the induction of the braking force (e.g. by counteracting the inertial force-induced movement of the at least part of the carriage and/or using the user interface 150), the electro-magnet may be controlled by the controller 151 so that it is proportionately de-powered to reduce or substantially avoid the braking force acting on the carriage. With the carrier 105 in the position of FIG. 14(*ii*), the electro-magnet will be partially depowered to reduce the braking force acting on the carriage 101. With the carrier 105 in the position of FIG. 14(*i*), the electro-magnet will be wholly depowered to avoid the braking force acting on the carriage 101. The features and functionality will otherwise be as described for the first described configuration of FIGS. 14(*i*) to 14(*iii*) above.

In yet another configuration of FIGS. 14(*i*) to 14(*iii*), component 111 may be a friction braking pad set up in proximity with a braking surface 113 on the track 115. The friction braking pad may be controlled by the controller 151 so that in a default mode in response to at least one inertial force acting on the carriage that causes movement of at least part of the carriage (e.g. the carrier 105 relative to the chassis 103), the friction braking pad 111 is applied to the track so as to cause a braking force on the carriage 101. The friction braking pad 111 will be physically moved in the same way described for the first described configuration of FIGS. 12(*i*) to 12(*iii*) above. The extent of downward movement of the friction braking pad 111 will depend on the extent of the non-counteracted inertial force-induced movement applied to the carriage. The controller 151 will be responsive to inertial force-induced movement to vary the extent of movement of the friction braking pad and therefore the extent of the braking between the carriage 101 and the track 115. Upon an action of an occupant of the carriage to counteract the induction of the braking force (e.g. by counteracting the inertial force-induced movement of the at least part of the carriage and/or using the user interface 150), the friction braking pad 111 may be raised by the controller 151 so as to become wholly or partly disengaged, to proportionately reduce or substantially avoid the braking force acting on the carriage. With the carrier 105 in the position of FIG. 14(*ii*), the friction braking pad 111 will be partly disengaged from the track to reduce the braking force acting on the carriage 101. With the carrier 105 in the position of FIG. 14(*i*), the friction braking pad will be wholly disengaged from the track to avoid the braking force acting on the carriage 101. The features and functionality will otherwise be as described for the first described configuration of FIGS. 14(*i*) to 14(*iii*) above. Rather than acting on part of the track, the friction braking pad may operatively engage with, and act upon, part of the carriage. For example, the friction braking pad may act on one or more of the wheels of the carriage.

The carriages 1, 101 described herein may be provided with a suitable on-board power supply, such as to power the controller, braking system, actuator(s), and/or sensor(s).

Preferred embodiments of the invention have been described by way of example only and modifications may be made thereto without departing from the scope of the invention. For example, in an alternative embodiment, the carriage chassis 3 comprises a permanent or electro-magnet, and the track 15 comprises a conducting fin. The carrier 5 could alternatively hold two or more occupants.

Rather than operating as the carrier traverses at least one of the curved portions of the track, the braking system may be configured to operate after the carriage has traversed at least one of the curved portions, to allow for actuation delay of the braking system. In another alternative, the braking system may be configured to operate both as and after the carriage has traversed at least one of the curved portions.

The amusement ride may comprise a launch system at the start of the ride. The launch system may optionally be operated by the carrier occupants to increase the competitive aspect of the ride.

The directions up, down, upper, lower, left and right are with respect to the carriage, in the configuration shown in the figures. The carriage may travel along a track in the upright orientations shown, or in upside-down orientations, or a combination of both.

The invention claimed is:

1. An amusement ride comprising:

a track having a curved portion;

a carriage for holding an occupant that is movable along the track, wherein the carriage is configured such that at least part of the carriage will move in response to at least one inertial force acting upon the carriage as the carriage traverses the curved portion of the track, in the absence of a counteraction by the occupant of the carriage; and a braking system that is configured to operate in response to the movement of the at least part of the carriage to induce a braking force to slow travel of the carriage;

wherein:

the braking system is configured, upon an action by the occupant of the carriage to counteract the induction of the braking force, to reduce or substantially avoid the braking force acting on the carriage;

the carriage comprises a chassis movably mounted on the track; and said at least part of the carriage comprises a part of the carriage that is movably mounted relative to the chassis and is configured to move relative to the chassis in response to the at least one inertial force acting upon the carriage as the carriage traverses the curved portion of the track, in the absence of a counteraction by the occupant.

2. The amusement ride as claimed in claim 1, wherein the at least one inertial force will cause the at least part of the carriage to at least one of roll, pitch, yaw, surge, sway, or heave.

3. The amusement ride as claimed in claim 1, wherein:
the braking system is a friction braking system, and
the braking system comprises a friction braking pad on the carriage, the friction braking pad being configured such that, in response to the movement of the at least part of the carriage relative to the chassis, the friction braking pad brakes movement of the carriage relative to the track.

4. The amusement ride as claimed in claim 3, wherein the friction braking pad is configured to operatively engage with part of the track to brake movement of the carriage relative to the track.

5. The amusement ride as claimed in claim 3, wherein the friction braking pad is configured to operatively engage with at least one wheel of the carriage to brake movement of the carriage relative to the track.

6. The amusement ride as claimed in claim 3, wherein the braking system is configured to cause the friction braking pad to become wholly or partially disengaged, upon the action by the occupant to counteract the induction of the braking force, to reduce or substantially avoid the braking force acting on the carriage.

7. The amusement ride as claimed in claim 1, wherein the part of the carriage is pivotally mounted relative to the chassis and is configured to pivotally move relative to the chassis in response to the at least one inertial force acting upon the carriage as the carriage traverses the curved portion of the track.

8. The amusement ride as claimed in claim 1, wherein the part of the carriage is slidably mounted relative to the chassis and is configured to move with a translational movement relative to the chassis in response to the at least one inertial force acting upon the carriage as the carriage traverses the curved portion of the track.

9. The amusement ride as claimed in claim 1, wherein:
the part of the carriage comprises a carrier for holding an occupant, the carrier being movably mounted relative to the chassis, and
the carrier is configured to move relative to the chassis in response to the at least one inertial force acting upon the carriage as the carriage traverses the curved portion of the track, in the absence of a counteraction by an occupant.

10. The amusement ride as claimed in claim 9, wherein:
the action by the occupant to counteract the induction of the braking force comprises an action to counteract the movement of the carrier relative to the chassis, and
the braking system is responsive to the action to counteract the movement of the carrier relative to the chassis, to reduce or substantially avoid the braking force acting on the carriage.

11. The amusement ride as claimed in claim 10, wherein the action to counteract the movement of the carrier relative to the chassis comprises the occupant physically moving the carrier relative to the chassis.

12. The amusement ride as claimed in claim 11, wherein the carrier is movable relative to the chassis by way of the occupant shifting their weight to move the position of a combined centre of mass of the carrier and occupant relative to the chassis.

13. The amusement ride as claimed in claim 1, wherein:
said at least part of the carriage comprises an articulated section of the carriage that is operable by an occupant, the articulated section being movably mounted relative to the chassis, and
at least part of the articulated section is configured to move relative to the chassis in response to the at least one inertial force acting upon the carriage as the carriage traverses the curved portion of the track, in the absence of a counteraction by an occupant.

14. The amusement ride as claimed in claim 13, wherein:
the action by the occupant to counteract the induction of the braking force comprises an action to counteract the movement of the at least part of the articulated section relative to the chassis, and
the braking system is responsive to the action to counteract the movement of the at least part of the articulated section relative to the chassis, to reduce or substantially avoid the braking force acting on the carriage.

15. The amusement ride as claimed in claim 14, wherein the action to counteract the movement of the at least part of the articulated section relative to the chassis comprises the occupant physically moving the at least part of the articulated section relative to the chassis.

16. The amusement ride as claimed in claim 1, wherein:
the action by the occupant to counteract the induction of the braking force comprises interaction with a user interface that is operatively coupled with the braking system, and
the interaction with the user interface reduces or substantially avoids the braking force acting on the carriage.

17. The amusement ride as claimed in claim 1, wherein:
the action by the occupant to counteract the induction of the braking force comprises interaction with a user interface that is operably coupled with a controller and actuator(s),
the interaction with the user interface causes physical movement of the at least part of the carriage, to counteract the inertial force-induced movement of the at least part of the carriage, and
the interaction with the user interface reduces or substantially avoids the braking force acting on the carriage.

18. An amusement ride comprising:
a track having a curved portion;
a carriage for holding an occupant that is movable along the track, wherein the carriage is configured such that at least part of the carriage will move in response to at least one inertial force acting upon the carriage as the carriage traverses the curved portion of the track, in the absence of an action by the occupant of the carriage to counteract the movement; and
a braking system that is configured to operate in response to the movement of the at least part of the carriage to induce a braking force to slow travel of the carriage, wherein:
the braking system is configured, upon an action by the occupant of the carriage to counteract the movement of the at least part of the carriage, to reduce or substantially avoid the braking force acting on the carriage;
the carriage comprises a chassis movably mounted on the track; and
said at least part of the carriage comprises a part of the carriage that is movably mounted relative to the chassis and is configured to move relative to the chassis in response to the at least one inertial force acting upon the carriage as the carriage traverses the curved portion of the track, in the absence of a counteraction by the occupant.

19. The amusement ride as claimed in claim 18, wherein the action by the occupant comprises physically moving the at least part of the carriage to counteract the movement of the at least part of the carriage, to thereby reduce or substantially avoid the braking force acting on the carriage.

* * * * *